US007674186B2

(12) United States Patent
Bitko et al.

(10) Patent No.: US 7,674,186 B2
(45) Date of Patent: Mar. 9, 2010

(54) DIRECTION AND DISTANCE CORRECTING GOLF PUTTER

(76) Inventors: David M. Bitko, 16 Valley Forge Dr., East Brunswick, NJ (US) 08816-3273; Sheldon S. Bitko, 16 Valley Forge Dr., East Brunswick, NJ (US) 08816-3273; Robert A. Coon, 237 Warren St., Edgewater Park, NJ (US) 08010; John Piotrowski, 12 Juniper Ct., South Ocean Pines, MD (US) 21811

( * ) Notice: Subject to any disclaimer, the term of this patent is extended or adjusted under 35 U.S.C. 154(b) by 0 days.

(21) Appl. No.: 11/805,506

(22) Filed: May 22, 2007

(65) Prior Publication Data

US 2008/0293513 A1 Nov. 27, 2008

(51) Int. Cl.
*A63B 53/04* (2006.01)
*A63B 53/06* (2006.01)

(52) U.S. Cl. ..... 473/329; 473/333; 473/340; 473/350

(58) Field of Classification Search ..... 473/251, 473/252, 255, 313, 324–350; D21/736, 741–744
See application file for complete search history.

(56) References Cited

U.S. PATENT DOCUMENTS 550,976 A * 12/1895 Jennings ..... 473/329

(Continued)

FOREIGN PATENT DOCUMENTS

JP 06238022 A * 8/1994
JP 09239079 A * 9/1997
JP 10080507 A * 3/1998
JP 10192460 A * 7/1998
JP 10277182 A * 10/1998

(Continued)

*Primary Examiner*—Alvin A Hunter
(74) *Attorney, Agent, or Firm*—Stuart M. Goldstein

(57) ABSTRACT

A golf putter has a putter head with an actively compliant beam which is parallel to the face of the putter. The beam connects to a shaft along its length and is separated from the head except for its ends. The force of impact between the face of the putter and the ball on the putter face sweet spot causes a stress to develop in the beam, resulting in a deflection in the beam proportional to the force of the impact, while maintaining the putter face orientation with respect to the putting line. Impacts which miss the sweet spot will cause the putter face to skew to an angle with respect to the putting line, also introducing a proportional flexure of the beam, depending on the distance between the sweet spot and the point of impact. The beam has a characteristic time such that as the force between the ball and the putter face decreases to zero after impact, the beam flexure simultaneously recovers causing the putter face to return to its original putting line orientation at almost the same instant the ball leaves the putter face, thereby providing distance and directional correction for mishit putts. Additionally, when a putter head with a suitable moment of inertia is coupled with an actively compliant beam, feel and alignment are substantially enhanced. The putter also uses a unique visual alignment sight line groove on the top surface of the putter head, extending from the face to the back of the putter. The groove is perpendicular to the face of the putter and may have tapered side walls. It is positioned directly above and parallel to the center of mass and the sweet spot, so that it can be positioned directly over the intended putting line when the putter is properly located on the putting surface. The base of the groove has contrasting stripes, so that when the golfer's dominant eye is properly located over the groove, the entire stripped base of the groove is visible to the golfer.

37 Claims, 16 Drawing Sheets

U.S. PATENT DOCUMENTS

| | | | | | |
|---|---|---|---|---|---|
| 890,836 | A | * | 6/1908 | Beale | 473/329 |
| 3,061,310 | A | * | 10/1962 | Giza | 473/329 |
| 4,010,958 | A | * | 3/1977 | Long | 473/341 |
| D244,303 | S | * | 5/1977 | Cabot | D21/739 |
| 4,871,174 | A | * | 10/1989 | Kobayashi | 473/252 |
| 4,979,744 | A | * | 12/1990 | Alcala | 473/341 |
| 5,080,365 | A | * | 1/1992 | Winchell | 473/255 |
| 5,316,304 | A | * | 5/1994 | Yost | 473/330 |
| 5,346,219 | A | * | 9/1994 | Pehoski et al. | 473/325 |
| 5,407,202 | A | * | 4/1995 | Igarashi | 473/342 |
| 5,527,035 | A | * | 6/1996 | Marshall | 473/230 |
| 5,533,728 | A | * | 7/1996 | Pehoski et al. | 473/252 |
| 5,577,965 | A | * | 11/1996 | Burgess | 473/230 |
| 5,749,790 | A | * | 5/1998 | Van Alen et al. | 473/245 |
| 5,820,481 | A | * | 10/1998 | Raudman | 473/313 |
| 5,865,687 | A | * | 2/1999 | Alzano | 473/313 |
| 5,899,819 | A | * | 5/1999 | Mount et al. | 473/329 |
| 6,354,956 | B1 | * | 3/2002 | Doong | 473/219 |
| 6,461,250 | B1 | * | 10/2002 | Klyve | 473/329 |
| 6,517,450 | B1 | * | 2/2003 | Klyve | 473/340 |
| 6,682,439 | B2 | * | 1/2004 | Brown | 473/329 |
| 6,695,715 | B1 | * | 2/2004 | Chikaraishi | 473/329 |
| 6,752,723 | B2 | * | 6/2004 | Cullen | 473/251 |
| 6,916,252 | B2 | * | 7/2005 | Bennett | 473/341 |
| 6,958,019 | B2 | * | 10/2005 | Rohrer | 473/324 |
| 7,004,849 | B2 | * | 2/2006 | Cameron | 473/249 |
| 7,086,959 | B2 | * | 8/2006 | D'Agguano | 473/282 |
| 7,128,660 | B2 | * | 10/2006 | Gillig | 473/324 |
| 7,163,467 | B1 | * | 1/2007 | Chang et al. | 473/329 |
| 7,163,469 | B2 | * | 1/2007 | Bonneau | 473/334 |
| 7,281,990 | B2 | * | 10/2007 | Hagood et al. | 473/329 |
| 7,351,161 | B2 | * | 4/2008 | Beach | 473/334 |
| 7,367,898 | B2 | * | 5/2008 | Hawkins et al. | 473/329 |
| 7,473,185 | B2 | * | 1/2009 | Anderson et al. | 473/325 |
| 7,491,131 | B2 | * | 2/2009 | Vinton | 473/251 |
| 2008/0051213 | A1 | * | 2/2008 | Blankenship et al. | 473/340 |
| 2009/0191979 | A1 | * | 7/2009 | Hou et al. | 473/332 |

FOREIGN PATENT DOCUMENTS

| | | | | |
|---|---|---|---|---|
| JP | 11042302 | A | * | 2/1999 |
| JP | 11155985 | A | * | 6/1999 |
| JP | 11192329 | A | * | 7/1999 |
| JP | 11244432 | A | * | 9/1999 |
| JP | 11299937 | A | * | 11/1999 |
| JP | 11333037 | A | * | 12/1999 |
| JP | 2000140169 | A | * | 5/2000 |
| JP | 2000237360 | A | * | 9/2000 |
| JP | 2001058015 | A | * | 3/2001 |
| JP | 2001218879 | A | * | 8/2001 |
| JP | 2001238988 | A | * | 9/2001 |
| JP | 2001346915 | A | * | 12/2001 |
| JP | 2002126140 | A | * | 5/2002 |
| JP | 2003000778 | A | * | 1/2003 |
| JP | 2003102877 | A | * | 4/2003 |
| JP | 2004016783 | A | * | 1/2004 |
| JP | 2004024317 | A | * | 1/2004 |
| JP | 2004174100 | A | * | 6/2004 |
| JP | 2005110852 | A | * | 4/2005 |
| JP | 2006296711 | A | * | 11/2006 |
| JP | 2007130203 | A | * | 5/2007 |

* cited by examiner

FIG. 8a
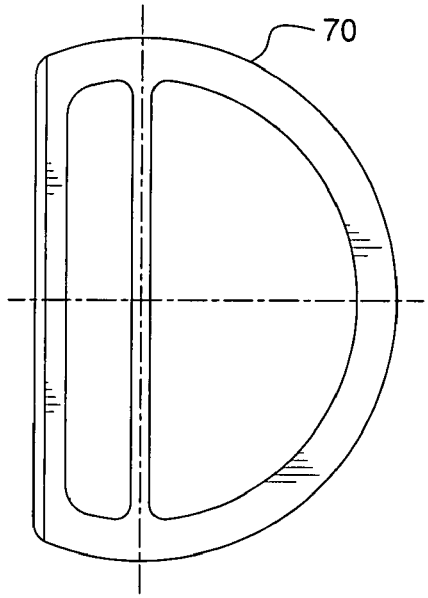
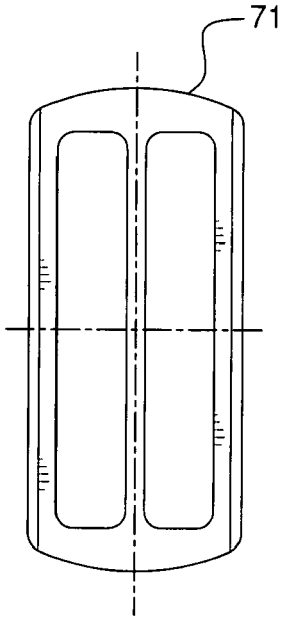
FIG. 8b
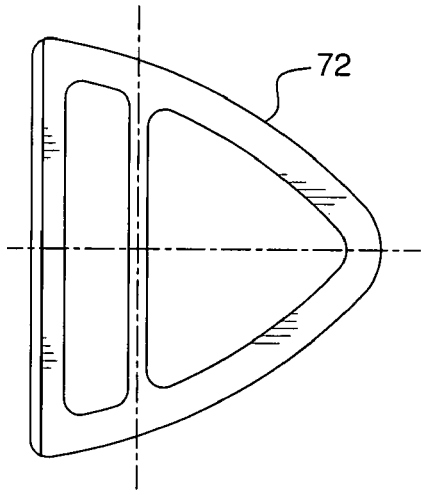
FIG. 8c

DIRECTION AND DISTANCE CORRECTING GOLF PUTTER

BACKGROUND OF THE INVENTION

It is generally accepted that preparation for a putt begins with the ability of the golfer to read the character of the green (with regard to slope, speed, grain direction, ball break, etc.) so that a proper putting line can be selected. While somewhat intuitive for a few golfers, this ability is usually developed as a result of practical experience which enables a golfer to develop a useful technique. Even so, it is normal even for many professional golfers to call on the services of their caddy for help in selecting a putting line and a suggestion of required ball speed. This step is so important, many golfers make use of a largely discredited technique called plumb bobbing, i.e. using the putter's shaft as a vertical reference guide. Still, a patent designed in accordance with U.S. Pat. No. 6,358,162 has been found to be United States Golf Association (USGA) conforming. This design provides accurate horizontal and vertical references, and has proven useful in estimating the slope of a green in all directions, especially around the hole, as well as confirming whether the flag pole, trees, fences and fence post references are truly vertical or horizontal.

Once a putting line has been selected, the golfer is faced with the need to impact the ball with enough putter head force for the ball to reach the hole while rolling on the intended putting line, without rolling too far past the hole if it does not drop. It is generally agreed that a repeatable technique is a prime and exquisitely difficult task to achieve, not only for tempo to control distance, but also to maintain putter face orientation to the intended putting line.

Every golfer has individual idiosyncrasies that can introduce variations in the swing path, face orientation and/or timing, so that the same result is not achieved even on repeated attempts to hole a putt of more than a few feet. As a result, putter designers concentrate on incorporating design elements which are either passive or active to compensate for these idiosyncrasies. In general, on almost all putts, golfers try to impact the ball on the putter's sweet spot, with the putter face perpendicular to the intended putting line. Passive elements include features which provide better ball aiming and alignment guides. In addition, incorporating a high moment of inertia passively reduces the magnitude of skewing of the putter face when the putter does not impact the ball on the putter's sweet spot. Active design elements include features such as elastomeric face inserts on the face of the putter where the ball is impacted, the flexing of which increases the dwell time of the ball on the putter face. This is intended to provide the putter face more time to square up to the putting line on impacts which miss the sweet spot and also to enhance feel.

All of these techniques result in various degrees of forgiveness and are regularly sought after by golfers at all levels of proficiency, since the saving of a single stroke can result in a score reduction of as much as 1.5% or more by a professional golfer, and as much as 1% by those less skilled. Since an 18 hole round of golf at par allows 36 strokes, it is easy to see how improvement in this single aspect of the game is so important.

SUMMARY OF THE INVENTION

The design intent of the putter of the present invention is to provide both passive and active design enhancement elements. As previously mentioned, passive improvements reduce the magnitude of the errors introduced by mishit balls, while active enhancements are intended to correct such errors, providing a larger degree of forgiveness. Active enhancement is accomplished by the invention by the introduction of an actively compliant beam which makes use of energy stored in the beam when it is stressed during ball impact and which is released in a timely fashion, thus bringing the putter face back square to the putting line at the instant of ball and putter face separation. Passive enhancement takes the form of strategically placed visual alignment groove sight lines on the top surface or crown of the putter. This feature results in truer alignment with the intended putting line during set up.

More specifically, the golf putter of the present invention comprises a head of an esthetically appropriate shape combined with an actively compliant beam which is parallel to the face of the putter. The beam connects to a shaft at a suitable location along its length and is separated from the head except for its ends. The force of impact between the face of the putter and the ball on the putter face sweet spot causes a stress to develop in the beam, resulting in a deflection in the beam proportional to the force of the impact, while maintaining the putter face orientation with respect to the putting line. Impacts which miss the sweet spot will cause the putter face to skew to an angle with respect to the putting line, also introducing a proportional flexure of the beam, depending on the distance between the sweet spot and the point of impact. The beam has a characteristic time such that as the force between the ball and the putter face decreases to zero after impact, the beam flexure simultaneously recovers causing the putter face to return to its original putting line orientation at almost the same instant the ball leaves the putter face, thereby providing distance and directional correction for mishit putts. Additionally, when a putter head with a suitable moment of inertia is coupled with an actively compliant beam, feel via the sense of sound, touch and alignment are substantially enhanced.

Used in combination with this unique putter head design is a visual alignment sight line groove on the top surface of the head, extending from the face to the back of the putter. The groove is perpendicular to the face of the putter and may have tapered side walls. It is positioned directly above and parallel to the center of mass and the sweet spot, so that it can be positioned directly over the intended putting line when the putter is properly located on the putting surface. The base of the groove has contrasting stripes, so that when the golfer's dominant eye is properly located over the groove, the entire stripped base of the groove is visible to the golfer.

Novel features which are considered as characteristic of the invention are set forth in particular in the attendant claims. The invention itself, however, both as to its design, construction and use, together with the additional features and advantages thereof, are best understood upon review of the following detailed description with reference to the accompanying drawings.

BRIEF DESCRIPTION OF THE DRAWINGS

FIGS. 8*a*-8*d* are top views of other design embodiments of putter heads employing the present invention.

DETAILED DESCRIPTION OF THE INVENTION

The Beam Putter

Figure 1:
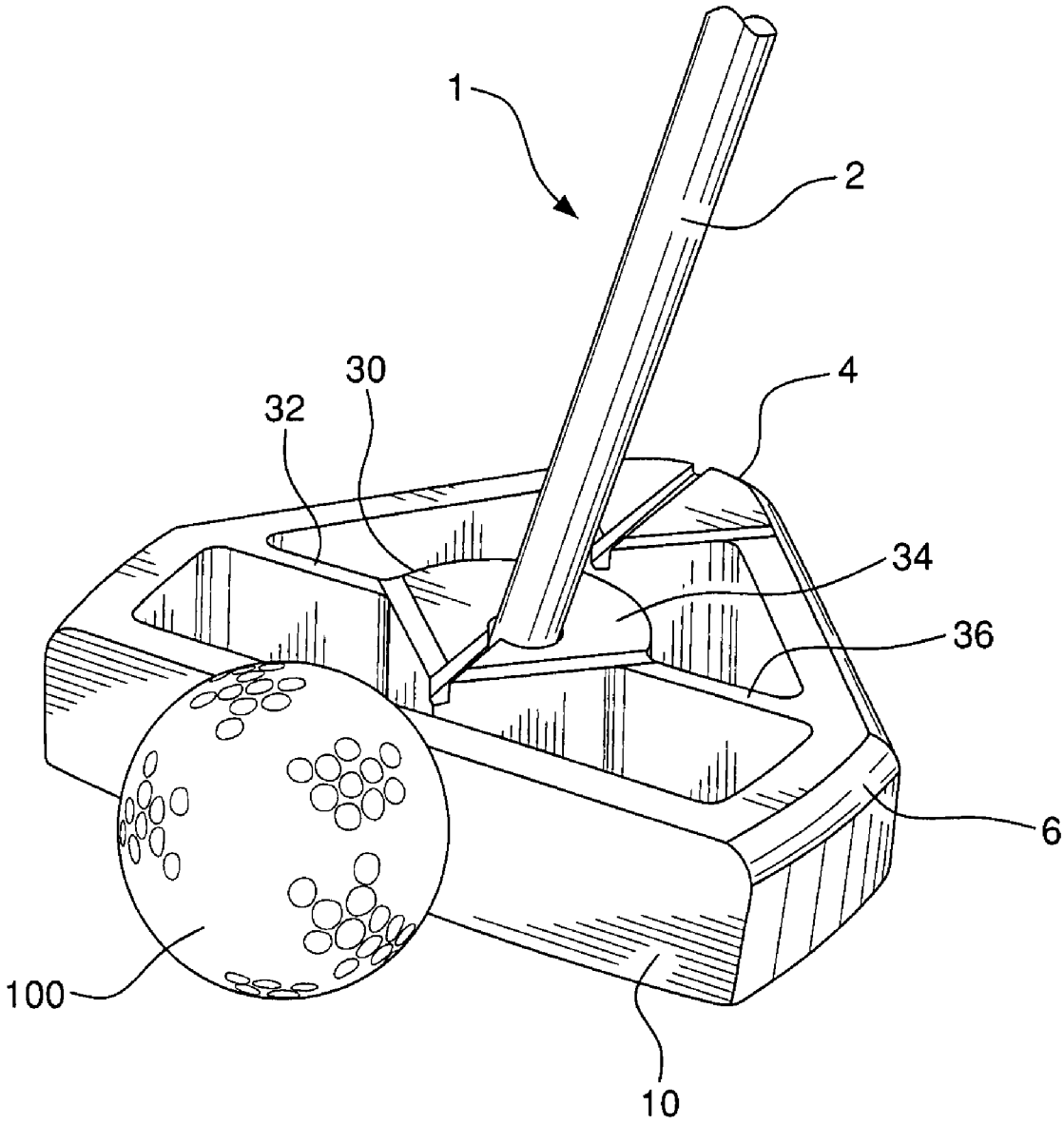
FIG. 1 is an isometric view of the putter of the present invention.

The preferred embodiment of the present invention, shown in FIGS. 1-4, comprises golf club 1 with golf shaft 2 and golf head 4. Head 4 can be provided with any number of different hosel designs and connections well-known in the industry and accepted by the USGA. While the shafts used on most standard putters fall in the 17-18 degree angle range, USGA requirements state that when a putter is soled to the putting surface in the normal manner, the shaft must have a tilt angle greater than 10 degrees from the vertical axis.

Head 4 of the present invention comprises unitary body 6 with transversely extending front member 8 having ball impact surface or face 10 and opposite back surface 12. As seen most clearly in FIG. 4, face 10 is offset at a slight angle 5, e.g. 4 degrees, from the vertical axis. Extending from member 8 are forward perimeter wall member 14 having forward section 16 and rear perimeter wall member 18 having rearward section 20. Wall members 14 and 18 extend the length of head 4, from front member 8 to back section member 41 which terminates at back end 22 of the head. Perimeter wall members 14 and 18 substantially surround an opening through unitary body 6. The opening comprises two small openings 19*a* and 19*b*. Head 4 has substantially flat top surface or crown 9 and a bottom surface comprising substantial planar sole 11 and minimally curved bottom surfaces 13 and 15. Weight balance port 17 is provided for the insertion or removal of added ballast material as needed to head 4.

Figure 3:
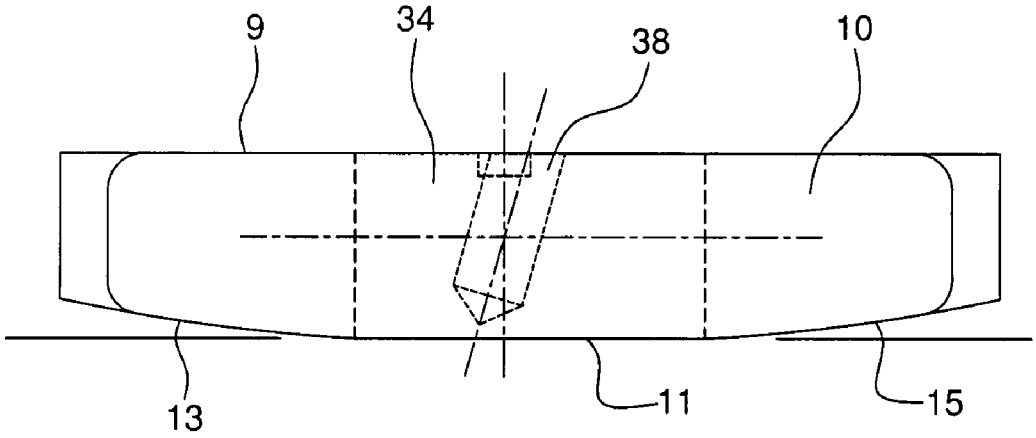
FIG. 3 is a front view of the putter head of the present application.
Figure 4:
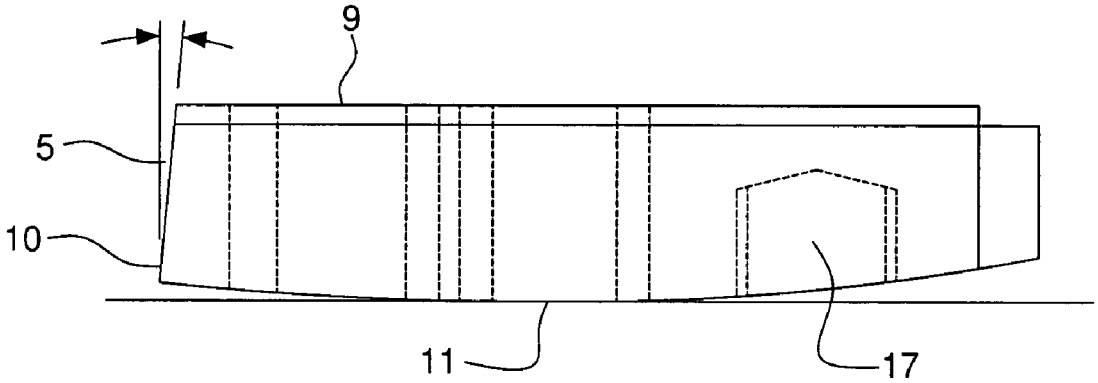
FIG. 4 is an elevation view of the putter head of the present application.

Actively compliant beam 30 comprises beam section 32 connected to wall member 14 at forward section 16 and central beam section 34, and beam section 36 connected to wall member 18 at rearward section 20 and central beam section 34. Beam 30 is positioned within the opening in unitary body 6, separating the opening into the smaller openings 19*a* and 19*b*. Shaft channel 38, within central beam section 34, for acceptance and connection of shaft 2 at USGA prescribed requirements, is provided. FIG. 3 shows shaft placement at approximately a 17 degree angle from the vertical axis. Putter shaft to putter head connection can be made by directly securing the shaft at an angle to beam 30, as shown, or inserting the shaft substantially perpendicular to the beam, after having it bent to the desired angle. It is also possible to connect the shaft by use of a hosel. Thus, different shaft to head angles can be accomplished by angling the shaft or using a separate angled hosel, bent to the angle of choice, inserted into beam 30.

While not to be considered restricted to specific size, typical exemplar dimensions for head 4, for reference only to show compliance with USGA requirements, would be 4⅞" from forward section 16 to rearward section 20, 4⅝" from face 10 to back end 22, and 0.97" from crown 9 to sole 11. Thicknesses of beam sections 32 and 36 of compliant beam 30 are also not to be considered restricted to any particular dimension. However, beam sections which are 3/32" in thickness have been shown to be one of several optimal designs. It is contemplated that typical exemplar weights of putter heads will be between 200 and 600 grams.

Indented into crown 9 are sighting alignment grooves 40 and 42 which are intended to lie directly on the putting line and above the putter face to the back axis, through the putter's sweet spot and above its center of mass. Arrow 44 indented into central beam section 34 and adjacent arrow 46 point in the direction of the impact portion of stroke. Rear arrowed section 45 of head 4 also provides for efficient easy adjustment of head "face to back" balance by permitting the addition or removal of ballast weight material to weight balance port 17. The configuration of arrowed section 41 assists in club takeaway movement so that both the takeaway and impact portions of the putting stroke are aligned with and on the intended putting line.

In use, the putting force of impact between face 10 of putter head 4 and the ball on the putter's sweet spot causes a stress to develop with beam 30, resulting in a deflection in the beam proportional to the force of the impact, while maintaining the putter face's orientation with respect to the putting line. Impacts which miss the sweet spot will cause putter face 10 to skew with respect to the putting line, also introducing a proportional flexure of beam 30, depending on the distance between the sweet spot and the point of impact. Beam 30 has a "characteristic time" such that as the force between the ball and putter face 10 decreases to zero as the ball starts to leave the putter face, the beam simultaneously recovers from flexure, causing the putter face to return to its original putting line orientation at almost the same instant the ball leaves the putting face. Distance and directional correction for mishit putts is the result.

Testing has revealed that if a golf ball of average hardness is struck with a relatively instantaneous (0.5-1.2 milliseconds) force of 24.7 pounds, the ball will leave the face of the putter with an initial velocity of 6.35 feet/second. This is the velocity of a ball at the instant it leaves a Stimpmeter, a commonly used device designed to provide a measure of green speed, prior to making contact with a putting surface.

To understand the significant advancement and benefit obtained when a putter head is provided with the actively compliant beam of the present invention, it is helpful to review the effect of a mishit with a conventional mallet putter.

Such is represented in FIGS. 5*a*-5*d*. These figures, as well as FIGS. 6*a*-6*d*, are for a righthanded golfer and omit the shaft in order to focus attention on the ball and head relationships. Note, however, that the shaft location is intended for a shaft passing through the center of mass of the putter head. However, the same results will be observed if the shaft intersects anywhere on the face to back axis which is perpendicular to the face of the putter and passes through the center of mass, as is common on many putters using shafts or hosels with one or more bends. Visualization is for motion from right to left, the center of mass being directly above the intended putting line for a sweet spot impact. It is noted that the magnitude of the rotation and deflections are enhanced for illustrative purposes.

Figure 5A:
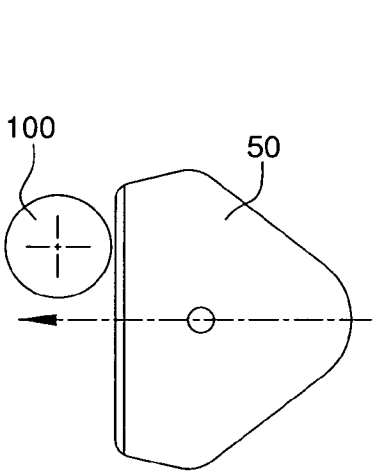
FIGS. 5*a*-5*d* are illustrations of commonly occurring golf ball to putter head impact and movement.
Figure 5B:
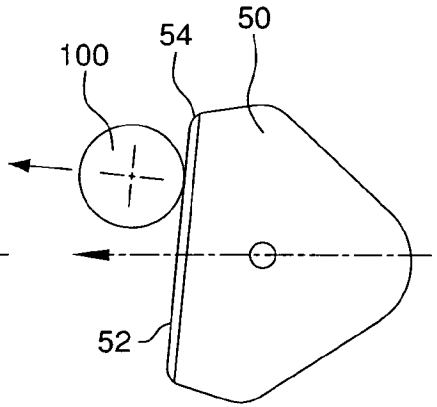
Figure 5C:
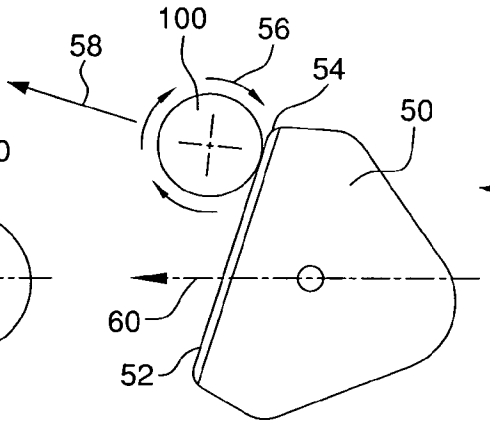
Figure 5D:
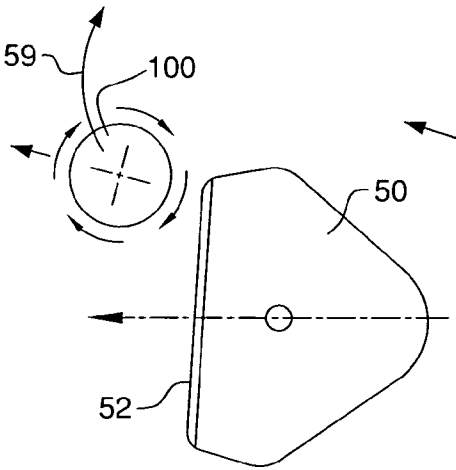

FIG. 5*a* illustrates ball 100 and conventional putter head 50 positioned at the instant before impact. FIG. 5*b* illustrates the positions of mishit ball 100 and head 50 slightly after impact. FIG. 5*c* indicates maximum ball compression and is the point at which the compression starts to reduce as the ball velocity exceeds that of head 50. While the initial direction of the ball travel path or putting line is indicated at 60, it is clear that ball 100 also rolls somewhat up putter face 52 towards toe 54, initiating clockwise ball rotation 56 while the ball and putter face are still in contact. This continues after ball 100 leaves the putter face in direction 58. FIG. 5*d* indicates recovery of putter face 52 perpendicular to the originally intended putting line 60, well after ball 100 has left the putter face traveling in undesired direction 59. Since ball 100 has a clockwise rotation, contact of the ball with the ground will cause the ball to "fade" and the direction of the ball travel 59 will be even more skewed (it is actually an arc) than the direction of travel 58 in FIG. 5*c*.

It is important to realize that the rotation of head 50 is a function of the torsional stresses produced in the shaft and grip as a result of the impact torque. Because these torsional rotations occur over a relatively large distance, recovery time is much too long to correct face orientation while ball 100 is still in contact with putter face 52.

Figure 6A:
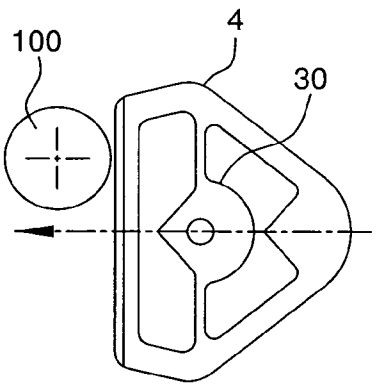
FIGS. 6*a*-6*d* are illustrations of golf ball to putter head impact and movement employing the putter of the present invention.
Figure 6B:
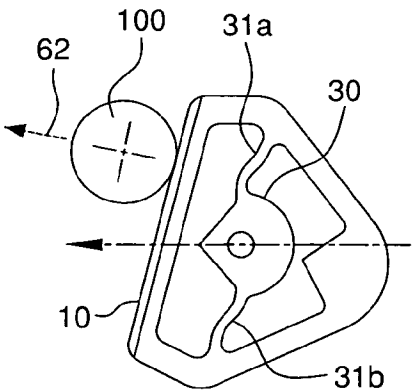
Figure 6C:
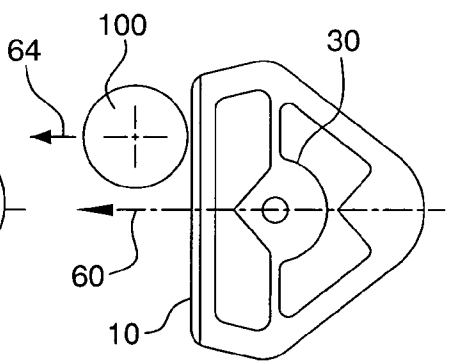
Figure 6D:
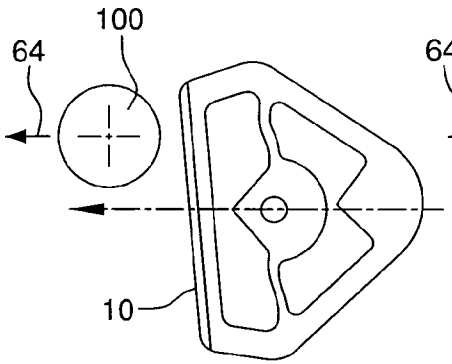

FIGS. 6*a*-6*d* show the effect of a mishit when ball 100 is struck with the golf putter head of the present invention. FIG. 6*a* illustrates the position of mishit ball 100 in relation to putter head 4 with beam 30 of the present invention at the instant prior to impact. FIG. 6*b* illustrates the point of maximum flexure 31*a* and 31*b* of beam 30, which is consistent with maximum ball compression, similar to that which is shown in FIG. 5*c*, in which ball 100 could potentially be misdirected 62. However, there is a finite time period, which is identified as the "characteristic time", during which the velocity of ball 100 and the velocity of putter head 4 are identical. During this period, beam flexure 31*a* and 31*b* is recovered and putter face 10 is returned towards being perpendicular to intended putting line 60. FIG. 6*c* shows the instant at which putter face 10 is returned to perpendicular in relation to putting line 60 and ball 100 leaves the putter face in direction 64, parallel to the putting line. It is evident that the design of beam 30 is critical in achieving this characteristic time which is the fundamental principle employed by the putter. In FIG. 6*d*, ball 100 has left putter face 10. However, although the energy stored in beam 30 due to the impact produces a harmonic oscillation which rotates putter face 10 so it is no longer perpendicular to putting line 60, it is of no consequence if the characteristic time is correct.

The importance of the characteristic time can be easily visualized. If the characteristic time is too short, putter face 10 will rotate past being perpendicular to putting line 60 and the putter face will present a closed relationship to ball 100. If the characteristic time is too long, putter face 10 will not have reached the targeted perpendicular position.

Beam Putter Development

Subsequent to the decision to pursue the beam putter head concept, input from the USGA was sought to determine whether the concept could meet the conformance requirements called for in the Design Of Clubs specification. Involvement of the USGA is integral to advancing golf equipment technology; and its guidance is extremely helpful to designers and manufacturers.

Because of its unique design, information regarding the requirements for the putter to be plain in shape, to be rigid, and to ensure it did not incorporate a tuning fork were considered and examined. While the wooden models displayed satisfied the plain in shape requirement, it was agreed that rigidity and the lack of tuning fork attributes could only be satisfied by hands on testing of models made to evaluate these characteristics.

Figure 14:
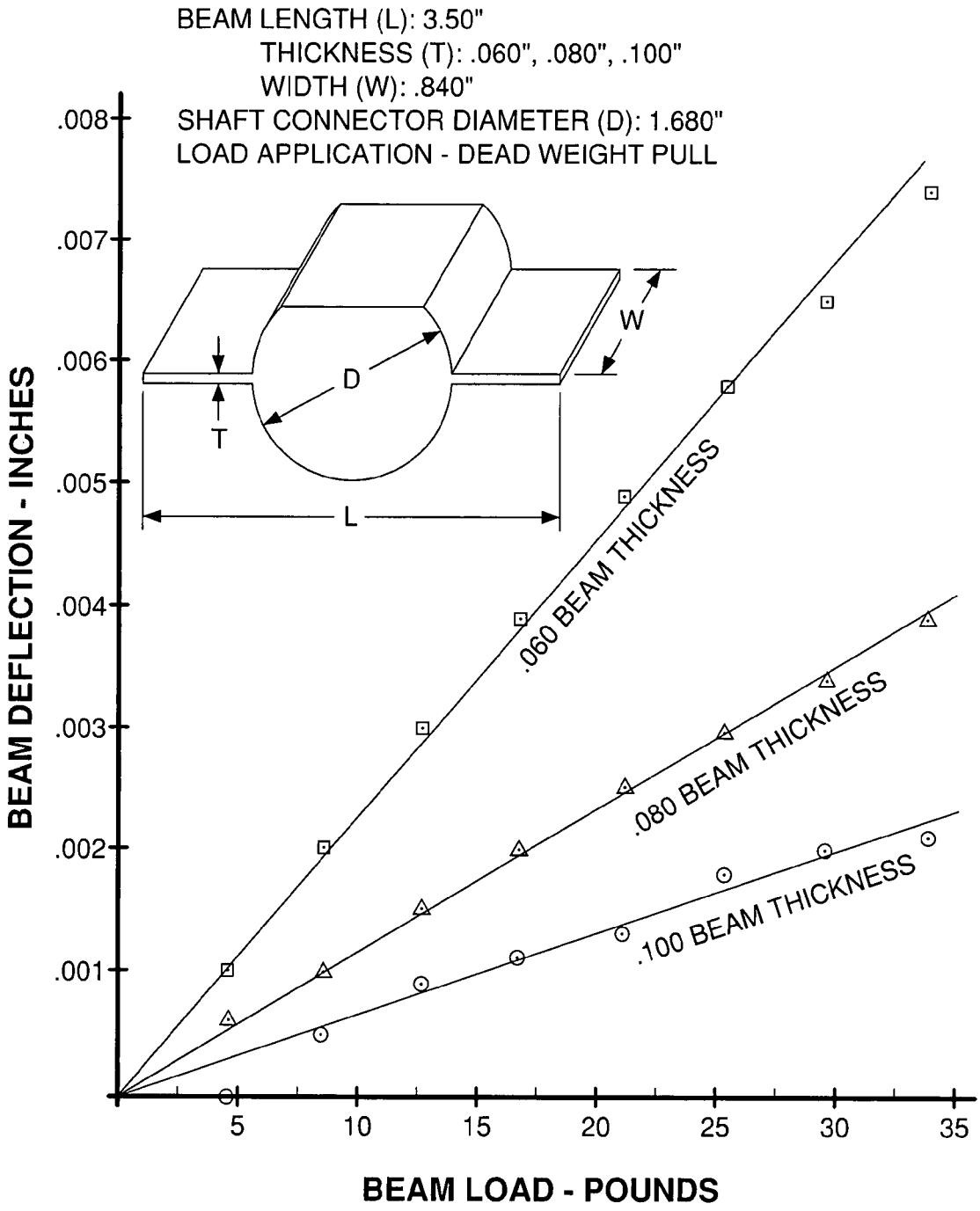
FIG. 14 is a graph showing test results of putter beams' deflection under load.

At the outset, it was agreed that the use of the word rigid was a very subjective term since when subjected to a load, it is probable that almost everything will move to a greater or lesser degree. At question was how much movement, or deflection, of the beam would be acceptable under manual loading. In the absence of a rigidity test specification for beamlike or similar elements of a putter (although one does exist for elastomeric inserts in the face of a putter as well as for the flexure in the face of woods and irons), it was agreed that the USGA would be provided with a testing apparatus and beams designed to evaluate the thickness of various beams with fixed length and height dimensions as they might be incorporated into actual production models. Test results for sample beams that were tested by deflection under load by use of a beam deflection testing apparatus are shown in FIG. 14.

The testing apparatus was designed so that manual force could be applied to the beam to determine whether movement of the beam could be discerned physically or visually. The test apparatus and results were provided to the USGA and it was concluded and agreed that a 0.100 inch thick beam with the length and height dimensions as shown and provided would meet the rigidity requirement. Note that while all these test beams were made of 6061-T5 aluminum, equivalent beams using other materials could be designed. It is necessary to recognize that any prototype or modification to a design previously found conforming is subject to USGA review in order to ensure that any such changes or unforeseen deviations in the manufacture of production clubs does not deviate from designs previously found conforming.

With the beam rigidity requirement resolved, the question of whether the beam could vibrate and produce a tunable sound like a tuning fork was studied. Although it is clear that the sounds generated by the impact of the putter head and a ball cover a wide frequency range, these sounds are a function of head design and shaft location. Accordingly, sample putter heads were built both with and without the beam and provided to the USGA. While the putter with the beam was suspended by the attached shaft during the test, the beam free putter head was suspended by fine threads at its corners. When each head was struck by a ball impacting at various locations along the putter face, it was found that there was no identifiable audible difference in sound frequency, confirming that the sound generated was a function of head design and not beam vibration. As a result, it was agreed that the beam putter concept met the tuning fork requirement.

Beam Putter Calculations

It is obvious that the number of beam designs that would be useful in this application are virtually endless. Of primary concern is the maximum beam deflection under manual load that would meet the rigidity requirements of the USGA. For this reason, calculations were limited to a simple flat beam fixed at each end with the load applied at the beam center. A useful compendium of beam formula for many other beam designs, including stresses and deflections, is found in the twenty second edition of the *Machinery Handbook* (22nd Edition) published by Industrial Press Inc., 200 Madison Ave., New York, N.Y., 10016.

The equation for the maximum deflection under load of the beam described above is given as Case 19 in the Machinery Handbook as:

$$y = \frac{Wl^3}{192EI} \text{ where} \tag{1}$$

$y$ = deflection, inches $W$ = load on the beam, pounds $l$ = beam length, inches $E$ = Modulus of Elasticity, and $I$ = Moment of Inertia and $$I = \frac{bd^3}{12} \text{ where} \tag{2}$$

$b$ = beam width, inches and $d$ = beam thickness, inches

Note that I, the Moment of Inertia for a beam, differs from I the Moment of Inertia for a mass moving around an axis, as indicated in torque inertia equations $I=\Sigma mr^2$ and $T=Ia$, where m is elemental mass, r is radius, T is torque and a is angular acceleration. In this case, the resistance to change of location of a moving mass is a function of the angular acceleration of the mass around its axis of rotation. I, the Moment of Inertia of a beam results in a change of shape of the beam under load, and reflects the beams rigidity.

Values for E, the Modulus of Elasticity for various materials have been reported as follows, all in millions of pounds per square inch.

| | | | |
|---|---|---|---|
| Aluminum | (T6061 alloy, heat treated and aged) | 10.0–11.4 | (depending on temper) |
| Brass | (360 Alloy) | 14–17 | (depending on temper) |
| Steel | (B1112, C1213 and most other Alloys) | 30 | |
| Stainless | (303 and most other SS Alloys) | 28 | |
| Tin Bronze | (cast) | 10–14.5 | (depending on alloy) |
| Alum. Bronze | (cast) | 15–18 | (depending on alloy) |
| Titanium | (6AL—4V, heat treated) | 15–16.5 | (depending on temper) |

From Eq. (1), since beam deflection is a function of the beam dimensions, applied load and Modulus of Elasticity of the beam material, Eq. (1) can be restated as $$y = \frac{W}{192} \cdot K_{bf} \text{ where}$$

$$K_{bf} = \text{Beam Factor} = \frac{l^3}{EI}$$

The beam factor $K_{bf}$ is especially useful, since once a beam of almost any design has been determined to have a suitable deflection under load, an equivalent beam having the same beam factor can be designed to suit manufacturing or other putter function purposes. For information purposes, the $K_{bf}$ of a 6061-T5 aluminum beam, clamped at both ends which is 3.500 inches long, 1.00 inches high and 0.100 inches thick equals 0.049.

Using this $K_{bf}$, examples of equivalent fixed end beams 3.500 inches long that would have the same deflection under load include a round cylindrical beam with a 0.203 inch diameter, a square beam with sides equal to 0.178 inches, and a beam whose cross section is an isosceles triangle with a height of 0.866 inches and a base width of 0.260 inches, among many other possible designs.

Additionally, the beam may be constructed of an alternative material with a different Modulus of Elasticity. Once again, it is necessary to recognize that any prototype or modification to a design previously found conforming is subject to USGA review in order to ensure that any such changes or unforeseen deviations in the manufacture of production clubs does not deviate from designs previously found conforming. The dimensions of this beam can be calculated using the $K_{bf}$ previously determined for 6061-T5 aluminum whose E has been taken as $10.5(10^6)$ pounds per inch$^2$, but correcting for the new Modulus of Elasticity. For example, if the new beam is constructed of stainless steel with an E equal to $28(10^6)$ pounds per inch$^2$, the E ratio of these materials equals 2.67. Changes may be made in the beam length l, beam width b, beam thickness d, or any combination of these. If it is assumed that the beam length and width remain constant, it can be seen that an equivalent 303 stainless beam would have the same $K_{bf}$ if the beam thickness equaled 0.072 inches, and would therefore have the same deflection under load as the 6061 aluminum beam. While this beam may also be esthetically desirable, the main reason to consider alternate beam length, width and thickness dimensions as well as the material used is to enable adjustment of the beams characteristic time in order to achieve the goals of the beam concept.

It is important to note that when a shaft adapter is attached to the beam, the deflection under load is reduced due to the increase in stiffness provided by the shaft adapter.

While it is possible to develop the equations for calculating beam deflection under this circumstance, it is also possible to provide this information by testing a sample beam with a shaft adapter (or equivalent stiffening plates) attached to a beam and measuring the deflection under load. The percentage reduction in deflection under load can then be used as a multiplier to modify $K_{bf}$, and alternate beam designs as described above can be established.

Also worth noting is that while the beam formula described above refers to beams with uniform cross sections, it is also possible to utilize beams that do not have uniform cross sections.

While it is possible to develop the equations for calculating beam deflection under this circumstance, depending on the complexity of the beam, estimates of a composite moment of inertia value for the beam using the same method described above may be more convenient.

What is most important to recognize is that the beam shape may be almost any design that meet the rigidity requirements of the USGA and which do not introduce nonconforming features.

Empirical Testing

In order to validate the effectiveness of the beam design of the invention, a putting table was constructed to test the effects of putter-ball impacts which were 0.5" and 1.0" from the sweet spot toward both the toe and heel of the putters tested. A putting table rather than a typical practice putting green was desirable due to the unavoidable presence of artifacts in any green that could introduce significant errors distorting the results. In addition, putting from the same spot on the same line introduces a channel in the green, disturbing the results.

The table constructed was approximately 22" wide by sixteen feet long. The table base consisted of a parallel pair of sixteen foot long nominal 2" by 4" wooden runners selected for flatness and straightness, connected to each other by five cross struts spaced approximately four feet apart. The runners and struts were positioned so that the 4" dimensions were vertical. Also, the cross struts were fastened so their top surfaces were approximately 1/32" below the top surface of the runners to allow for providing a small recess running down the sixteen foot length of the table when a pair of two foot by eight foot sheets of 1/2" thick underlayment plywood with one side finished was screwed to the table base. In addition, five leveling jacks were positioned in each of the sixteen foot runners to provide for leveling of the construction both before and after the underlayment was added, to compensate for subfloor, table base, and underlayment layer unevenness, as well as to allow for tilting the table lengthwise to provide the ability to calibrate the Stimpmeter speed of the table. The height of the leveling screws were adjusted for a truly horizontal (within the limits of the levels utilized) surface both across the width and length of the table.

Once the table was constructed, two coats of vinyl-concrete cement were skived down the length of the table to provide a reasonably flat surface across the width and to minimize any irregularities in the underlayment boards. After sanding, two layers of a rubberized vinyl elastomeric caulking compound were skived onto the vinyl-cement layer followed by two additional layers of a self-leveling thick rubber-acrylic paint that was similarly skived down the length of the table to provide a softer subsurface. Golf balls were manually rolled down the table length and across the width to insure there were no significant artifacts present and two layers of 1/16" thick felt were stretched and stapled across the width and down the length of the table. A pair of 1/8" thick by 1 1/2" wide by sixteen feet long wood strips were attached at each side of the table as buffers running lengthwise and another crosswise at the end of the table to prevent balls from running off the table at the sides or the end during testing.

It was found that when the table was truly horizontal across both width and length, the Stimpmeter speed of the table was over fourteen feet. The table was then tilted by making use of the leveling screws so test putts ran uphill. In order to arrive at the target Stimp speed, it was found that a table slope of approximately 0.7 degrees (approximately a 2 3/8" rise in the 16 foot length) was necessary.

Finally, in order to measure travel length and ball position, a metal tape measure was permanently attached on top of the wooden buffer strip along the right table edge running its full length, while an aluminum dimensional T-square was used to determine ball location from the left edge of the table.

Also constructed was an apparatus that would provide a calibrated pendulum stroke to a wide variety of putters. In order to eliminate the damping and other effects of the grip, the clamp devised locked onto the shaft of the putter below the grip and was tightened to the same level on all putter shafts. The center of the clamp was approximately 19" above the putting surface, but depending on the shaft position of some putters with a large face to back dimension, it required raising of the putter head slightly to prevent it from scuffing the table on the follow-through of the swing, allowing the length of putter shafts to vary somewhat. It was also found that in order to prevent a swing stroke from the inside, it was necessary to very accurately level and horizontally clamp the pendulum shaft to which the putter clamp was attached. Adjustments to putter balance were provided by balancing weights so that the putter face would impact the ball when the face of the putter was at its lowest position (the projection of the shaft on a plane perpendicular to the putting surface and parallel to the swing plane being vertical) in all cases in order to provide comparable results.

With the shaft completely vertical and at rest, the ball was placed on the table approximately 1/32-1/16" in front of the putter face. Twelve tests were made at five face locations, i.e. the sweet spot, 1/2" and 1" towards the toe and 1/2" and 1" towards the heel. Each putter was adjusted so the ball would travel an average of ten feet, +/−2" when impacted on its sweet spot. This was accomplished by increasing or decreasing the arc the pendulum shaft was allowed to rotate through by adjusting a stop to meet the ten foot +/−2" travel average when tested at the sweet spot of each putter. This arc was held constant throughout the entire test sequence for each putter. Offline deviations were then calculated by measuring the distance between the average sweet spot location on the x axis, while distance deviations were measured from the same sweet spot location on the y axis.

Prior to formal testing, it was noted that slight variations in the true location of the center of mass of the test balls could have a substantial effect on ball travel distance and line. As a result, a motorized ball spinner was used, without success, to locate a great circle through the true center of mass and the theoretical location. In addition to finding non-repeatable locations of the dot and great circle locations, it was difficult but necessary to align the great circle plane exactly vertical and on the putting line during test runs.

Also evaluated was the floating ball technique, wherein a dot is placed on the top surface of a ball barely floating to enable location of the exposed surface precisely. This positioned a great circle through both the actual center of mass as well as the theoretical center, although marking it, except for the floating dot, was not necessary. When the marked dot on the topmost surface of the ball was used to position the ball in front of the putter face, the ball could be rotated horizontally through 360 degrees, so that it was not necessary to position a specific great circle directly over the putting line. Nevertheless, in order to position the test ball so it was properly positioned with regard to the intended impact spot on the putter face and orientated the same way for each putter undergoing test, the selected ball was marked in this manner and, additionally, an arrow was placed on the great circle identified so all test putts were made using the same ball rolling in the top forward direction. Even so, some difficulties were encountered when it was determined that, on rare occasions, an atypical error in ball location occurred. As a result, in all cases the two worst readings of the twelve taken were eliminated, although in almost all cases, they were within or close to the +/−2 Sigma target range.

Finally, in evaluating balls suitable for testing, it was found that two piece balls came closest to meeting the necessary requirements, although several three piece balls were also found acceptable. For the purposes of the tests, a Titleist DT SO/LO®, was used for all the putters tested, keeping as close to the same orientation and direction of roll as possible. The ball was retested several times using the floating ball technique throughout the putter test cycles, without any noticeably significant changes developing.

Figure 7:
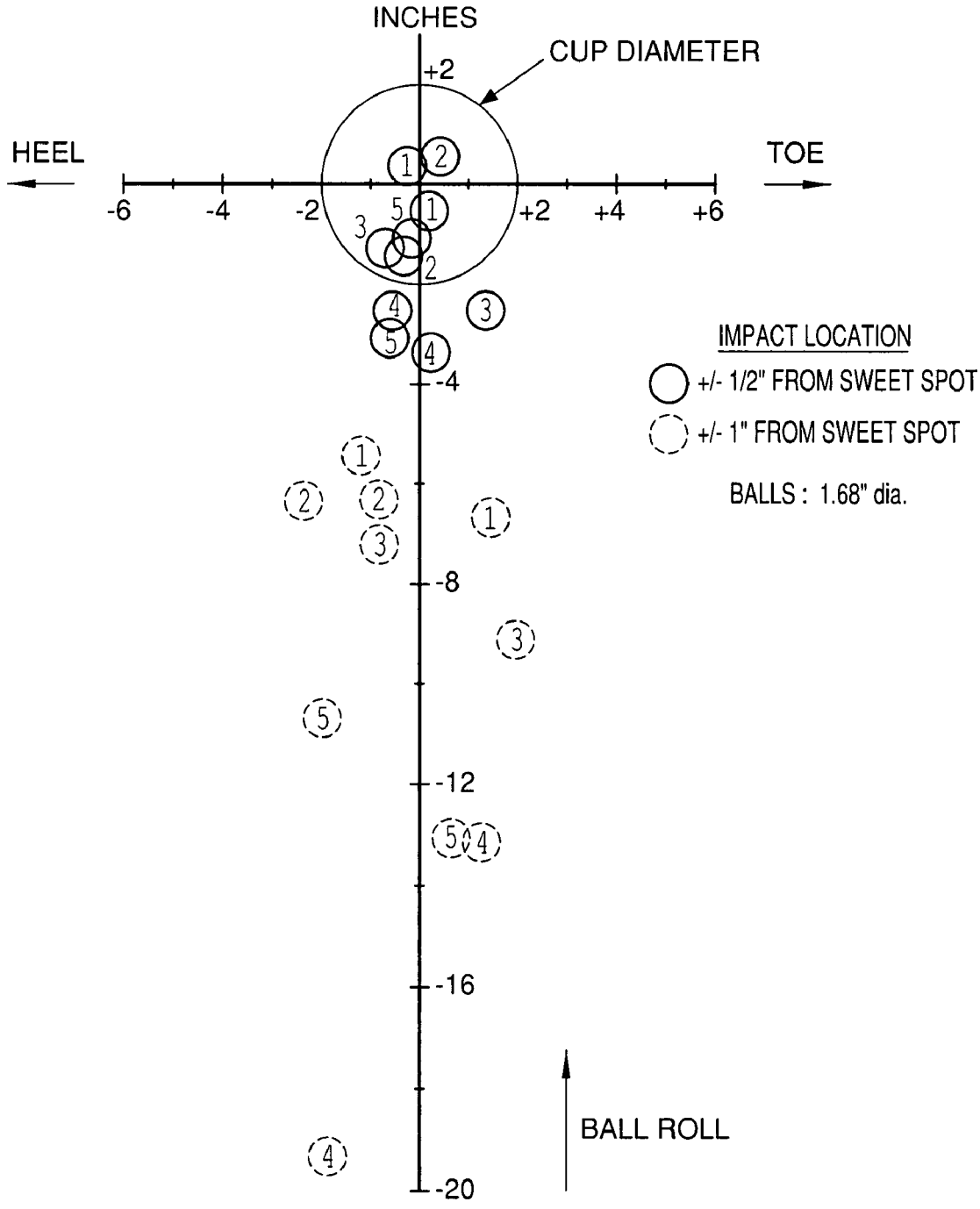
FIG. 7 is a graphic representation of test results.

A chart summarizing the results of the putting tests is set forth below and FIG. 7 is a graphic illustration of these tests. A comparison of the test results confirms the validity of the beam concept as originally hypothesized.

cup diameter entirely. Nevertheless, it is important to note that on all five putters tested, even those putts which do not reach the hole, they are only about 1" from the hole and are at tap in distance.

The same cannot be said for impacts which are 1" from the sweet spot. While ball centers for beam putters 1 and 2 are between 3½" and 4½" from the cup edge, and beam putter 3 is somewhat further away at 5¼" and 7", putter 4 results are 11" and 17½" from the cup edge while putter 5 results are 8½" and 11" from the cup edge.

These results clearly show the validity of the characteristic time concept of the beam putter design. As stated previously, energy stored in the deflection of the beam is recovered prior to impact and imparted to the ball as the ball leaves the putter

SUMMARY OF PUTTER TESTS ON TEST TABLE

| | DIRECTION--INCHES | | | | | DISTANCE--INCHES | | | | |
|---|---|---|---|---|---|---|---|---|---|---|
| | DISTANCE BETWEEN SWEET SPOT AND | | | | | | | | | |
| | HEEL | | SS | TOE | | HEEL | | SS | TOE | |
| Putter | 1.0 | 0.5 | 0.00 | 0.5 | 1.0 | 1.0 | 0.5 | 0.00 | 0.5 | 1.0 |
| 1 3/32 BEAM | −1.20 | −0.24 | 0.00 | +0.19 | +1.46 | −5.42 | +0.36 | 0.00 | −0.53 | −6.67 |
| 2 5/32 BEAM | −2.35 | +0.43 | 0.00 | −0.33 | −0.83 | −6.34 | +0.55 | 0.00 | −1.43 | −6.31 |
| 3 7/32 BEAM | −0.83 | −0.70 | 0.00 | +1.34 | +1.95 | −7.19 | −1.27 | 0.00 | −2.52 | −9.10 |
| 4 MALLET | −1.85 | −0.56 | 0.00 | +0.22 | +1.26 | −19.32 | −2.52 | 0.00 | −3.35 | −13.14 |
| 5 HI MOI | −1.96 | −0.16 | 0.00 | −0.60 | +0.65 | −10.67 | −1.07 | 0.00 | −3.07 | −13.07 |

Putters 1-3 are beam putters of the subject invention intended to demonstrate the effect of beam thickness. In all other respects, putters 1-3 are identical, including the shaft and grip. Putter number 4 is a very popular mallet style putter which provides an elastomeric putter face. Putter number 5 is also a very popular high moment of inertia design which also contains an elastomeric face insert. Both were selected to serve as base line putters against which beam putters were compared on the basis of their performance reputation in PGA tournaments. In order to simulate blind testing as much as possible, raw test data on all putters was collected prior to data analysis and reduction of this information to the differential measurements from the sweet spot is shown on the chart. It is worth noting that the shaft and grips used on all three beam putters appeared to be the same as those used on putter number 4.

The results shown on the graphic representation in FIG. 7 are not surprising in that the average ball centers for all five putters tested at all four (½" and 1" spacing, toe and heel) impact locations are within 2" or slightly over 2" from the sweet spot vertical axis. This is indeed the rationale behind high moment of inertia designs intended to reduce twisting of the putter head in order to keep the ball on or close to the intended putting line. In the same sense, compression of an elastomeric putter face insert is intended to keep the ball in contact with the putter face longer, allowing the putter face more time to square up in order to keep the ball on line.

What is of greater interest and importance is that when the impact location is at the ½" toe or heel location for beam putters 1, 2, and 3, five of the six ball centers are inside a theoretical 4" ball cup diameter located at the sweet spot average location for that putter (the sole exception being the ½" toe hit of beam putter 3); yet only one of the number 5 HI MOI putter balls is similarly located, and both of the number 4 putter hits at the ½" toe or heel location miss the theoretical face, providing improved ball roll distance, as well as maintaining optimum control of direction.

Additionally, it would appear that when elastomeric putter faces or inserts are employed, the characteristic recovery time may be so slow, the ball has left the putter face before the stored energy can be released to the ball, resulting in smaller ball travel distances on impacts which deviate from the sweet spot. Similarly, when the putter face is all metallic, the only place where energy can be stored for later release is in the ball itself. In this case, the amount of energy that can be stored due to ball compression as a result of a putt impact is so little, it may for all intents and purposes not have any effect on ball travel. Finally, consideration of energy storage in the shaft as the result of impact flexure shows that the characteristic recovery time is so slow, the ball has also left the putter face long before this energy exerts any effect.

A similar analysis of putter impacts with regard to direction and distance is contained in a book by Alastair Cochran and John Stobbs titled *Search for the Perfect Swing*, published by Triumph Books, Chicago. In one experiment which was performed, balls were impacted on the sweet spot and 1" in each direction towards the toe and heel using a conventional blade type putter. Balls impacted on the sweet spot traveled a distance of 11 feet, 2½", while balls impacted 1" towards the toe and 1" towards the heel traveled 9 feet, 0" and 9 feet, 2½" respectively. These correspond to a differential from the sweet spot travel distance of approximately 24" and are directly comparable to the 11" and 17½" spacing found in the above test for putter number 4. At the same time, Messrs. Cochran and Stobbs found that the offline differential from the sweet spot were 8" and 7", corresponding to 6" and 5" distances to the theoretical cup edge respectively for toe and heel impacts, which are substantially larger than the differentials found for the putters of the subject invention. Clearly, directional control is substantially better for high MOI and beam putters as theorized.

While travel distances for a ten foot putt stopping two feet short of the hole are not considered tap ins, it would still be expected that probably 90% or more of these putts, depending on green conditions, would be sunk. On the other hand, if a twenty or thirty foot putt would stop four feet or six feet short of the hole, these would fall in the range that most golfers, including many professionals, would consider troublesome.

The conclusion to the above is that properly dimensioned beam putters will not only adhere closely to the putting line, but if they are properly optimized for the beam's characteristic recovery time, impacted balls would travel for a distance comparable to the sweet spot travel distance, even when impacted as much as ½" off the sweet spot.

Putt Distance Control

As has been shown empirically (see FIG. 7 and corresponding discussion) and as is known anecdotally, the further from the sweet spot the ball impact location is, the shorter is its travel distance. Golfers facing a downhill putt have two choices. Either they can reduce the impact force at the sweet spot, or they can purposely impact the ball close to the toe of the putter face with the same force they would use as if they were hitting a level putt for the same distance. This effect exists regardless of the MOI value of the putter in use, even though closer adherence to the intended putting line increases as the MOI of the specific putter increases by weight disposition and even though the mass of the putter remains constant.

This apparent paradox can be easily understood by making use of the Conservation of Energy principle. The total kinetic energy of a putter at the instant before contact with the ball can be expressed as:

$KE_p = ½ m_p v_{p0}^2$ where $m_p$=putter mass and $v_{p0}$=head velocity at time 0.

During the time period that the ball and putter face are in contact, energy is transferred from the putter to the ball. If energy loss due to ball and/or putter face deformation are ignored along with other energy consuming deflections (i.e. shaft, grip, etc.), and the impact location is on the sweet spot, this can be equated as:

Total $KE$=$KE$ of the putter prior to impact=Residual $KE$ putter+$KE$ ball, or Total $KE = KE_p = ½ m_p v_{p0}^2 = ½ m_p v_{p1}^2 + ½ m_b v_{b1}^2$ where $v_{p1}$=putter velocity=$v_{b1}$=ball velocity at time 1 when ball and putter face just separate.

However, when the impact location is not on the sweet spot, a turn producing force is introduced around the center of mass of the putter head. This is expressed as Torque=Fr=Iα where, as previously identified, F is the impact force, r is the distance from the center of mass perpendicular to the impact force vector, I is the moment of inertia and α is the angular acceleration of the head.

For any value of T during the turning moment, higher MOI putter heads reduce the value of angular acceleration α, and subsequently Θ, the included angle of rotation is lessened. Nevertheless, work is done by the applied torque through this angle of rotation, and can be expressed as TΘ since TΘ=(Iα)($w^2$/2α), or the kinetic energy consumed by the work of rotation of the putter head equals ½ $Iw^2$. As a result, the kinetic energy available to be transferred to the ball is less than that available when impacted on the sweet spot and the ball.

Total $KE$=$KE$ of the putter prior to impact=$½ m_p v_{p1}^2 + ½ Iw^2 ½ m_b v_{b1}^2$.

Since the value of kinetic head energy ($½ m_p v_{p1}^2$) available to impact the ball is now reduced by the loss of rotational energy ($½ Iw^2$), the resultant energy available to be imparted to the ball is reduced and the ball travel distance will be lessened.

It is worth noting that while the included angle of rotation Θ would be extremely small with very high MOI putter heads, the total angle of rotation of concern includes the torsional rotation developed by the putter shaft (quantified by shaft manufacturers as low, medium or high torque shafts), the rotation in the grip due to its elastomeric nature, the rigidity of gripping the putter due to the strength of the hands gripping the club, as well as the elastomeric nature of the ball and putter head interface when an elastomeric insert is used on the putter face.

The conclusion to be reached is that even with very high MOI putter heads, many other independent and dependent variables contribute to the loss of energy that can be transmitted to the ball during impact resulting in loss of distance. The beam concept of this invention provides for storage of most, if not all of this rotational energy in the deflection of a beam located between the hosel and the putter face and which is returned to the putter face during the time the putter face and ball are in contact, if the putter head has the proper characteristic time. This greatly reduces any effect deflections of the shaft, grip and grip rigidity can introduce.

No other putter has, in the past or present, approached this level of distance control. While the claims of high MOI putter are correct in that they more closely adhere to the intended putting line, high MOI putters do not, in of themselves, provide any active distance correcting features, and as discussed below, high MOI putters result in a lower magnitude of the sense of touch as it relates to feel, further exacerbating the problem of distance control.

Feel

A definition of the meaning of feel as it relates to golf has been as elusive as the search for a perfect ball or club. Indeed, the June, 2005 of *Golf Digest* magazine is dedicated towards feel in all its aspects: tactile feel, kinesthetic feel, visual feel, intuitive feel, and sound feel. With regard to the subject invention, these five kinds of feel are considered as follows:

1. Tactile fee, or the sensations perceived by the fingers or hands. The sense of touch is as a result of impact.
2. Kinesthetic feel, or an awareness of what the body and club are doing during the swing. This combines the senses of sight and time during setup and the swing prior to impact.
3. Visual feel, or the ability to see the swing/stroke as it is taking place.
4. Intuitive feel, or the ability to imagine a shot before it takes place. It is a combination of all the senses of touch, sight, sound and timing as imagined mentally or in a practice swing.
5. Sound feel, as heard by the golfer during the swing or at impact with the ball.

The first issue that has to be resolved is whether any of the senses perceived during the putting stroke can have a cognitive or reflexive response to alter the swing while it is taking place. Given that the contact time of the putter and ball is typically in the range of 0.5-1.2 milliseconds, and the time it takes for a signal from the brain to reach the hands after receiving the stimulus is on the order of 10 milliseconds (nerve travel speed is approximately 300 feet/second), cognitive feel for a response to the sense of touch is not possible since the ball is long since gone from the putter face. In the same sense, while a reflexive response to an impact with the ball might trigger a responsive reaction, it is not likely that the muscles in the arms or hands can respond before the ball is gone from the putter face. Even reflex actions require a muscle activation time.

Also, since the sound of the impact takes at least 2-5 milliseconds to even be heard (the speed of sound in air is approximately 1087 feet/second at STP), there can be neither reflexive nor cognitive response to the sense of the sound of the impact that could have an effect on the ball.

When considering the effect of the sense of sight to the putting stroke for both the kinesthetic and visual aspects, it is reasonable to expect the complete take away and impact portion of a putting stroke to have a duration time somewhere between $1/8^{th}$ of a second and 3 seconds or longer. If a visual input during the stroke indicates the club is not on the correct putting line on either the takeaway or impact portions of the stroke, it is possible that a signal from the brain can reach the body, arms, or hands quickly enough to alter the stroke, which implies a cognitive response. While the responsive reaction may be beneficial, under or over correction is more likely, resulting in a wide range of mishit responses, including short, long, pushed or pulled balls, and even yips, and is clearly to be avoided. The implication is that alignment (or aiming) of the putter consistent with the intended putting line is significantly important at set up, the takeaway and the impact portions of the stroke.

Finally, the intuitive sense suggested is, in all likelihood, the most important factor since it relies on the storage in the brain of inputs from all the active senses. For example, while practicing on a putting green before a round, and assuming the Stimp speed of all the greens is consistent, the senses of touch and sound translate to how much force is required for the ball to travel a given distance. These senses are stored in the brain for future recall during the round as are visual and timing senses, all of which may be derived from both long and short term memories.

The bottom line to putting feel is that a stroke delivered as intended is the result of the integration of all the memories stored in the brain and their application as it applies to the stroke in question. It is reasonable to expect that anything that amplifies or modulates the intensity, frequency, or duration of the memory of these senses strengthens useful memory recall.

While the descriptions above constitute what is the generally accepted philosophy useful for establishing a putting technique, once the putting line has been established, control of the distance the ball travels is the most significant requirement for a useful putting stroke, and the generally accepted philosophy described above is not necessarily the best possible technique.

Touch

The sense of touch refers to the signal created when pressure is applied to most portions of the body. Some areas have a greater response than others, and the level of response of course varies between golfers. Nerve endings below the skin act as sensors which are chemically converted and passed along for transmission to the brain. Note that sensitivity refers to pressure, not force. This can be demonstrated easily by rubbing the flat surface of a comb over a portion of the hands with a small force, following this by applying the same force but with the points of the comb tines making contact. It is normal to find that the finger tips are relatively less sensitive to the contact than are the palms of the hands. Much of this is due to the loss of sensitivity of the finger tips as a result of various degrees of abuse the fingers have been subjected to over time. Typical is the constant pressure applied when simply using a writing instrument. This is unfortunate in that it is the finger tips where the greatest pressure of an exerted force can be sensed, while the more sensitive palms distribute the exerted force over a much larger area resulting in a lower pressure that can be sensed for transmission to the brain for analysis. For this reason, many golfers grip the clubs in various ways to try and enhance touch by contacting the club along the fingers or palms, as in the claw or other styles. Nevertheless, the ball and putter face impact forces as they are generated can be analyzed to determine how they respond to various putter designs as they apply to the sense of touch. There are two forces which can be considered. These are:

a) The natural resonant frequency of the putter including the shaft and grip.

b) The force transmitted by the ball-putter face impact traveling through the head and up the shaft.

With regard to a) it is believed that virtually everything has a natural resonant frequency. This ranges from the earth itself having a first resonance peak at about 7.8 Hz. (the Schumann resonance) to ocean waves, musical instruments, gongs, pipes, rods, liquids, atoms, and of course golf clubs. These natural resonant frequencies are a function of their structural materials as well as their physical shape.

The impact of the putter head striking the ball initiates two energy waves. These are the impact shockwave and the sound wave (discussed later) at frequencies determined by the geometry and composition of the putter head and of the ball. Typically, while the shockwave energy dissipates itself by friction within the atomic structure of the head as it ricochets within the club head, some of it will find its way up the shaft to the grip. Note that Huygen's principle of a shockwave emanated from a point impact will radiate in all directions from the contact point and that the wave front is in phase in all directions as it radiates through the head until it impacts an interface and rebounds. By locating and measuring the magnitude of the shockwave up the shaft, the node or point of maximum response can be determined.

While an accelerometer can be used to determine this location as well as the shockwave frequency, a relatively simple observation of this can be made by suspending the putter in a vertical position by holding it very lightly in the fingers of one hand near the bottom of the grip while striking the face of the putter with a ball in the other hand. By changing the suspension point by small increments up or down the shaft, the point of maximum vibration can easily be determined. Note that by suspending and holding the putter with a string fixed at the butt end of the grip to minimize dampening, a much lighter force can be exerted by the fingers making it still easier to sense. Also, holding it near an ear at the node will enable the golfer to hear the sound wave set in motion by the vibration of the shaft at this point for an estimate of the vibration frequency. Normally, the comparative magnitude of the vibration can be sensed by touch as well as by sound since the duration of the audible signal is typically 2-3 seconds or longer.

The distance between this point and the impact point with the ball is ¼th the wavelength of the shockwave, and is approximately 2 to 2½ feet from the sole of the putter head for many putters with a shaft length of 35" and a head weight of approximately 350 grams. Thus the wavelength would be approximately 8-10 feet. The shockwave frequency can also be determined experimentally and typically appears to be on the order of 15-35 Hz. From Eqs. (6) and (7) below, this equates to a shockwave velocity of approximately 250 feet/ second (approximately 0.5% of the velocity of sound transmission in aluminum), and a period of approximately 40 milliseconds which is well past the point at which the ball leaves the club face. Nevertheless, this is an important observation since it is the point where the fingers or palm should be located to maximize the sense of touch of the impact which in turn provides a measure of the impact force and which fundamentally is what we are interested in as a measure of ball travel distance.

(b) While the resonant frequency of the putter was determined above by the initiation of a shock wave, it is of interest to consider the mechanism by which the shock wave travels up the shaft. Any impact on a surface will produce a stress on both of the impacting members. In a putter, these stresses will strain the lattice structure of a metal putter face adjacent to the point of impact which in turn will transfer some of this strain to adjacent atoms making up the lattice structure. As was previously indicated, some of these strains will find their way up the shaft and while some of the stresses will dissipate as friction between atoms making up the lattice structure, the largest part of the stresses will be distributed as a flexure in the shaft and grip. These stresses can be, and in an impact that misses the sweet spot usually are, both linear and torsional. While these strains will absorb the force of the impact and still exist long after the ball leaves the putter face, a significant part of them will travel up the putter shaft as a result of the kinetic energy the atoms acquire as a result of the impact. The variables contributing to the transfer of this energy include both the independent and dependent variables previously described. As the strains and vibrations developed as a result of the ball impact harmonically decay, they can be sensed by the golfer and are usually attributed by the golfer as a property of the putter. Most commonly, they are described as having a "hard" or "soft" feel, with long decay times characterizing a "soft" feel. One must also recognize that the character of the golf ball in use also has a major effect on these properties.

While the errors introduced by differences in the absolute values of these variables can be analyzed from both linear and rotational calculations, visualization of these variables by their electrical analogs can provide a clearer understanding. The following chart provides the mathematical relationships between mechanical and electrical analog parameters.

| Mechanical Parameter | | | Electrical Analog | |
|---|---|---|---|---|
| Impact Force | F | is equivalent to | Voltage | V or E |
| Mass | M | " | Inductance | L |
| MOI | I | " | Impedance | Z |
| Friction | F | " | Resistance | R |
| Stored Energy | E | " | Capacitance | C |
| Velocity | V | " | Current | I |

While the electrical equivalents indicated are relatively simple to understand, it is worth noting that the reason that I is the analog for V derives from the fact that current is the transfer of charge (Q) as a function of time.

$$I = \frac{dQ}{dt} \text{ just as } V = \frac{ds}{dt}$$

When the putter strikes the ball, the force F can be equated to voltage V, the magnitude of which is proportional to the force of impact. This initiates a shockwave energy pulse which is dissipated by the friction of atoms rubbing against each other as the pulse travels through the head. In a DC relationship, Ohms Law (I=V/R) is the electrical analog for V=F/F, where V represents the velocity of the shockwave force F as it dissipates its energy as friction F. Since it is obvious that the shockwave F is not a single pulse, but travels at a wavelength as previously described and which is a function of the geometry of the putter head, this analysis can be continued as an alternating current analog I whose frequency is determined from the shockwave velocity. What is significant is its relationship to the touch sense of feel. The shockwave impulse is not a square wave but builds up and decays as a function of the Young's Modulus of the impact interface materials. For simplicity, the shockwave can be considered to have the general form of a sine wave.

From Eq. (1) the electrical analog E=IZ and Eq. (2), or $E=IZ=I\{R^2+(X_L-X_C)^2\}^{1/2}$ it is clear that as R and/or $X_L$ increase so does Z, and I must decrease. Since Z is the electrical analog for the moment of inertia, an increase in Z is the equivalent of an increase in MOI. Translated to its mechanical equivalent, this means that the magnitude of the mechanical pulse V reaching the shaft of the putter is reduced, resulting in a smaller sense of touch as it applies to the magnitude of the impact of the putter face and the ball that is available for the Nomenclature For Electrical Analogs

| | | | | | |
|---|---|---|---|---|---|
| V or E | Voltage | I | Current | Z | Impedance |
| R | Resistance | L | Inductance | C | Capacitance |
| $X_L$ | Inductive Reactance | $X_C$ | Capacitive Reactance | F | Friction |
| E | Stored Energy (as in a stressed beam) | f | Frequency in cycles/sec. | ω | Angular Velocity in radians/sec. |
| v | Wave velocity | λ | Wavelength | p | Period |

Mathematical Relationships (1) $E = IZ$ (2) $Z = \{R^2 + (X_L - X_C)^2\}^{1/2}$ (3) $X_L = \omega L$ (4) $X_C = \frac{1}{\omega C}$ (5) $\omega = 2\Pi f$ (6) $v = f\lambda$ (7) $p = \frac{1}{f}$

Electrical Analogs

The following analog equivalents are assigned to assist in understanding the analysis that follows. Italics are used to distinguish between parameters employing the same font characters.

sense of touch to recognize. It is interesting to note that in an electrical circuit, an inductance L is referred to as a "choke", indicating its effect in reducing the flow of current in the circuit, or as its mechanical equivalent, the magnitude of the impact of the putter with the ball.

Stated in simpler terms, the significance of this is that the higher the moment of inertia, the lower is the overall feel provided by the reduction in the magnitude of the sense of touch.

On the other hand, from Eq. (2), there is an optimum value of $X_C$ where $X_C=X_L$ and the total reactance equals zero, the value of I becoming a function of the resistance R only. Translated to its mechanical equivalent, this means that the magnitude of the shockwave pulse V as expressed by its electrical analog I reaching the shaft of the putter must increase, resulting in a larger feel for the impact of the putter face and the ball that is available for the sense of touch to become aware of.

Again stated in simpler terms, the significance of this is the energy storage provided by the putter beam (whose electrical analog is the capacitor) results in a decrease in the moment of inertia and an increase in the overall feel provided by the accompanying increase in the magnitude of the sense of touch. There is an optimum value of a putter's moment of inertia for both accuracy and the sense of touch as it relates to feel. Putters with moments of inertia between 2000 and 8000 gram·cm$^2$ are contemplated.

Sound

The velocity of sound generated and transmitted within the club head is entirely a function of the club head material. For information purposes, the longitudinal speed of sound in brass, aluminum and steel respectively are approximately 15,400, 21,050 and 19,000 feet/second, while the transverse speed for these materials are approximately 6925, 9975 and 10,175 feet/second. At STP, the speed of sound in air is only 1087 feet/second. The frequency of the sound wave is determined by both the geometry and material of the club head resulting in vibration of the surface atoms of the putter and producing an audible sound. Obviously, the net speed of sound transmission is a function of the combination of both longitudinal and transverse wave transmission, thereby putting Huygen's principle in perspective. Putters typically have a sound frequency ranging between 10-3000 Hz.

As was noted previously, everything, including atoms of materials, has a natural resonant frequency. As was assumed in the previous electrical analog analysis that a sine wave was responsible for the transfer of energy, sound waves also travel as sine waves but their origin is a little different. The impulse shock wave developed on contact with the ball cannot be a truly square wave since both the ball and putter faces are each elastic materials with a Modulus of Elasticity specific to the materials being used. It follows therefore that deformation of both materials occur at the interface, and that increasing compression occurs on impact over time. It is also reasonable to believe that constant maximum compression will exist for some finite time duration, following which compression is lost as the ball starts to leave the putter face. The shape of the force curve during the rise and the fall times as the ball leaves the putter face is a function of the impact force as well as the materials of construction and can be determined by use of an oscilloscope if desirable. Despite the above analysis, it is necessary to bear in mind that the total time the putter face and ball remain in contact during a putt has been measured to be between 0.5-1.2 milliseconds. Typically, less than one thousandth of a second, and the audible component of the sound generated has not yet traveled ⅓ of the distance to the golfer's ears.

Whatever this single pulse wave shape is, it can be simulated by Fourier analysis into a series of overlapping half sine waves that, in sum, duplicate the wave shape of the impact force. Since several of these half sine sound waves will be at a frequency close enough to the resonant frequency of any atom it may strike, reinforcement will occur if it arrives in phase. By adding its kinetic energy to the energy of the atom's natural resonant frequency sine wave, the atom's potential energy is increased, and which in turn is converted to a higher energy full sine wave as the potential energy is recovered. This in turn causes other atoms in the putter head to higher peak magnitude levels as energy is transferred to other atoms throughout the head. This includes the shaft unless its path is restricted from transferring its vibration by the mechanical structure of the putter head or by some other means of damping. While much of the impact energy is lost in friction between atoms, once the atoms on a free surface are set into vibration, it transfers this wave motion to air atoms adjacent to the putter free surfaces and the characteristic sound of the putter impact is perceived by the golfer's ear.

It is important to recognize that shaft location in the head plays a significant role in the frequency and magnitude of sound produced. This can be demonstrated by using a wine glass as an analogy. If the wine glass is held by its base and the bowl portion of the glass is struck, the vibrations generated will set air atoms adjacent to both the inside and outside of the bowl in motion. The observed frequency will be a function of the tuned column of air on the inside of the wine glass bowl modified by the harmonic generated by the outside of the glass coupling to exterior air atoms. If the wine glass is grasped by its stem and the cup struck, little variation in sound frequency and/or magnitude will be sensed. This remains true even though the stem may be grasped very close to the bowl. If the cup is touched while it is vibrating, it will immediately be damped and the frequency, magnitude and vibration duration will be greatly reduced. Continuing, if the wine glass is grasped by the bowl and struck, all that generally can be heard is a dull thump. The point is that damping is a critical factor in the sound produced, and the narrow diameter stem serves to isolate the vibration wave from the damping effect of the stem holder.

If this analogy is applied to a putter, it is apparent that the wine glass stem represents the shaft of the putter while the bowl represents the putter head. If reference is made back to the electrical analogy developed for the analysis of the force wave transmitted to the hand, a similar analysis shows that the impedance of the stem, which is mainly resistive, blocks most of the force wave from reaching the hands. On the other hand, touching the bowl of the wine glass increases the mass of the system and the result is an increase in the moment of inertia, the major effect of which is the damping of the bowl's vibration. Increased mass also equates to a lower resonant frequency for a wine glass of the same size and shape but with a higher glass density.

These observations also apply to the observed frequency of a putter. Isolation of the shaft from the vibrating head will result in a higher resonant frequency and a longer duration of vibration, both of which are important contributors to the overall feel provided by sound, and also the implied sense of "time". The frequency and duration of the impact sound is important in that the larger the magnitude that can be perceived is, the stronger is the stored memory. This is important in that it is easier to distinguish a small change in level when the base line of comparison is large rather than small. For example, if the information stored in memory of an impact is five seconds long, an impact sound duration of one second will easily be identified. On the other hand, if the duration stored in memory is approximately 1.5 seconds long, an impact duration of one second could barely be differentiated. Since the duration of the impact sound wave is a measure of the force applied for a given putter, it is not only a significant contributor to the concept of "feel", it is in fact a much larger contributor than the sense of touch.

In order to follow the reasoning behind the importance of the impact frequency, one must recognize that sensitivity to hearing different frequencies varies from person to person. In fact, the well known Fletcher-Munson and Robinson-Dodson equal loudness curves indicate that frequencies between 1000 and 4000 hz. are more easily heard by most people than frequencies at lower or higher frequencies. This of course is what leads to bass and treble boost for high fidelity music response in an attempt to have all frequencies perceived by listeners to be at the same loudness level of hearing for flat response. The impact sound frequency of between 1000 to 4000 hz. is also considered the applicable range for which most golfers have the greatest sensitivity.

In an experiment to evaluate the vibration damping of the beam putter of the present invention, as a result of the beam and its connected shaft, a frequency measurement of the sound was made as a result of the ball impact, and was determined to be approximately 1400 Hz. The beam was then severed from the head at the point where it was connected, and the head was suspended by several strings so that it was disposed in a typical putting orientation. A ball was then allowed to impact the putter face close to the putter's sweet spot. There was no discernible difference in the frequency of the impact sound at any impact force attempted. It was also clear that both the magnitude of the sound and its duration were both a function of the impact force. With regard to the frequency for the design tested, only one test observer felt that it was somewhat harsh, and indicated he preferred a slightly lower frequency. This person also indicated that after he used the putter on a test green for a while, he "got used to the sound". It is worth noting that several methods of altering the sound frequency can be employed, including dimensional and material modifications. An estimate of sound frequencies that would provide the benefits of discernible sound magnitudes and durations that would be most widely acceptable is at the lower end of the equal loudness curves described above. In this regard, the vibration of the original Ping Solheim putter, U.S. Pat. No. 3,042,405, has been described by many users as disconcerting, even though it is within the equal loudness curves described above, but closer to the higher frequency end.

Putter Head and Putter Face Design

The beam concept of this invention can be included in virtually any putter head design. All that is necessary is that there be clearance completely around the beam and shaft connector, except at the beam ends, as is depicted in FIGS. 2 and 8*a*-8*d*.

Figure 2:
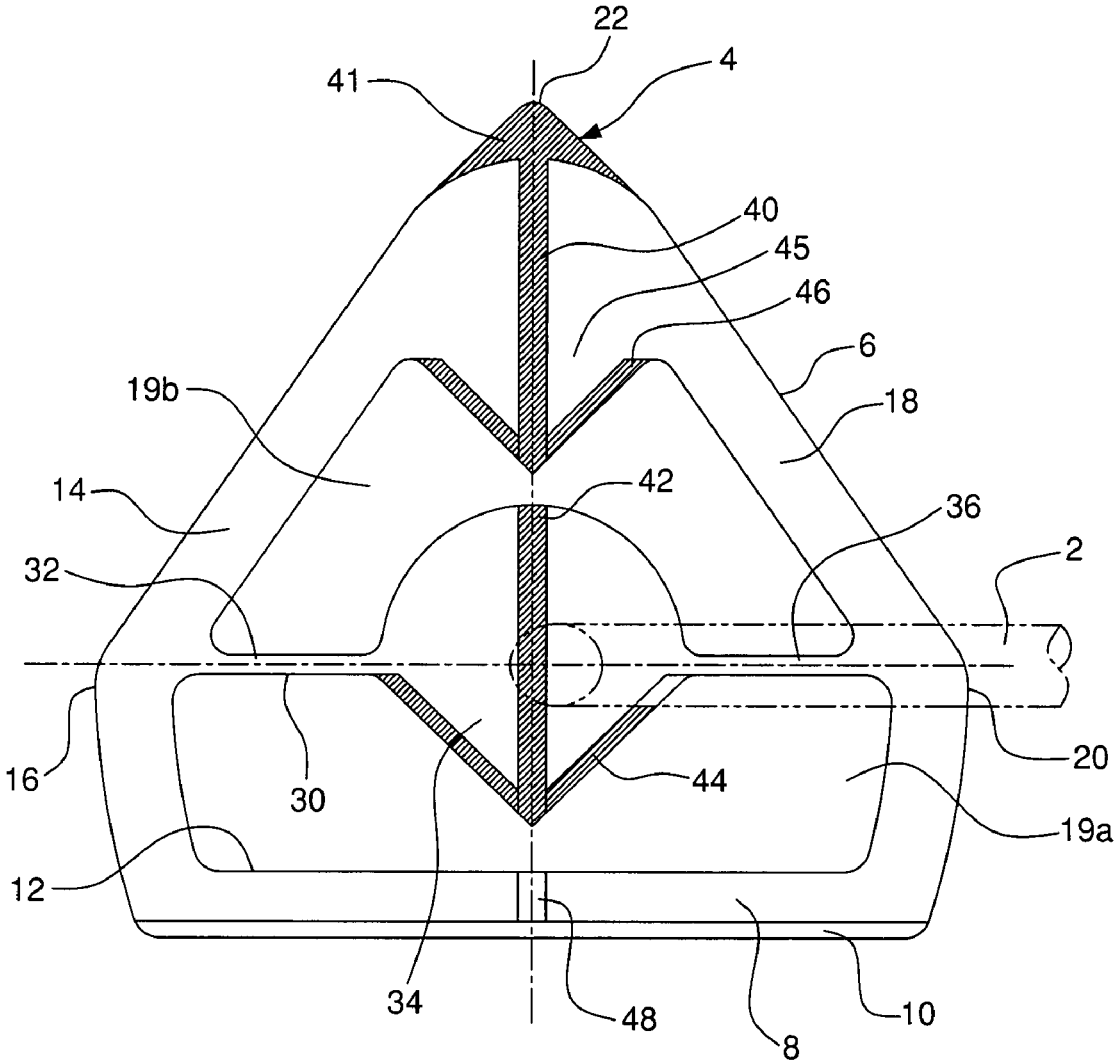
FIG. 2 is a top view of the putter head of the present application.

In FIG. 2, the top view of a preferred head design, the dimensions previously described are typical and for reference only to show compliance with USGA requirement. The large clearance between the beam-shaft connection at central beam section 34 and wall members 14 and 18 allow for adjusting the moment of inertia to a desired value simply by adding or deleting material to these outside wall members. Additionally, the harmonic oscillation decay of beam 30 from face 10 towards the back of the putter suggests the placement of groove 42 and arrow 44 on the connection at central beam section 34 and similarly shaped arrow 46 on back section 45. Groove 40, also on back section 45, representing the sighting line for both the forward direction and stance set up, as well as arrowed section 41 cited directly above the putting line and pointing in the direction of the takeaway stroke, provide visual aids in adjusting the swing to suit the recommended technique. As discussed previously, back section 45 permits easy adjustment of face to back balance by the removal or addition of weight to weight balance port 17. Finally, replacement of the connection at central beam section 34 as an assembly to provide for both a desirable characteristic time and beam shape, can be facilitated in the initial manufacturing process as well as in field replacement, provided a proper replacement tool is available. The latter requirement must meet USGA requirements to prevent such replacement during a round.

Figure 8D:
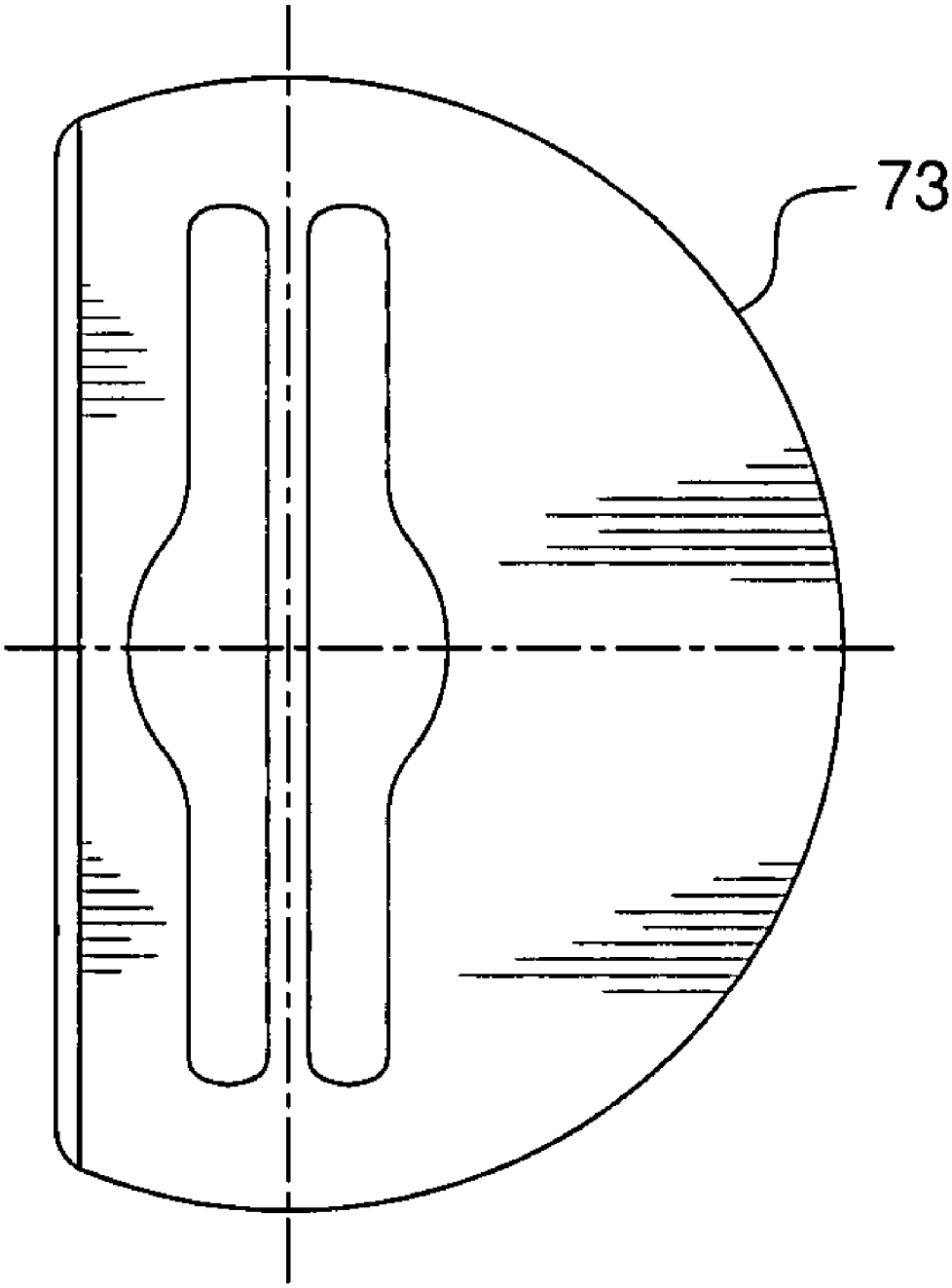

FIG. 8*a* is a top view of head 70, a simplified version of FIG. 2, based on a segment of a circle where the face of the putter is a chord selection to provide the shape and length of the putting face. FIG. 8*b* is a top view of head 71, a rectangular shaped head, similar to a bulls eye putter, which provides putting faces on both the front and back faces of the head. FIG. 8*c* is a top view of head 72 in a three sided concept, into which many of the features described for FIG. 2 may be incorporated. FIG. 8*d* is a top view of head 73, except that the only open areas in the head are those required to provide clearance around the beam and its shaft connector, allowing the beam to function as required. This is essentially a mallet putter design.

The head designs shown in FIGS. 2 and 8*a*-8*d* are only to be considered examples of the use of the beam technology of the invention and are not exclusive to these putter head designs. It is contemplated that other equivalent designs using the beam concept are within the scope of this invention.

Figure 9A:
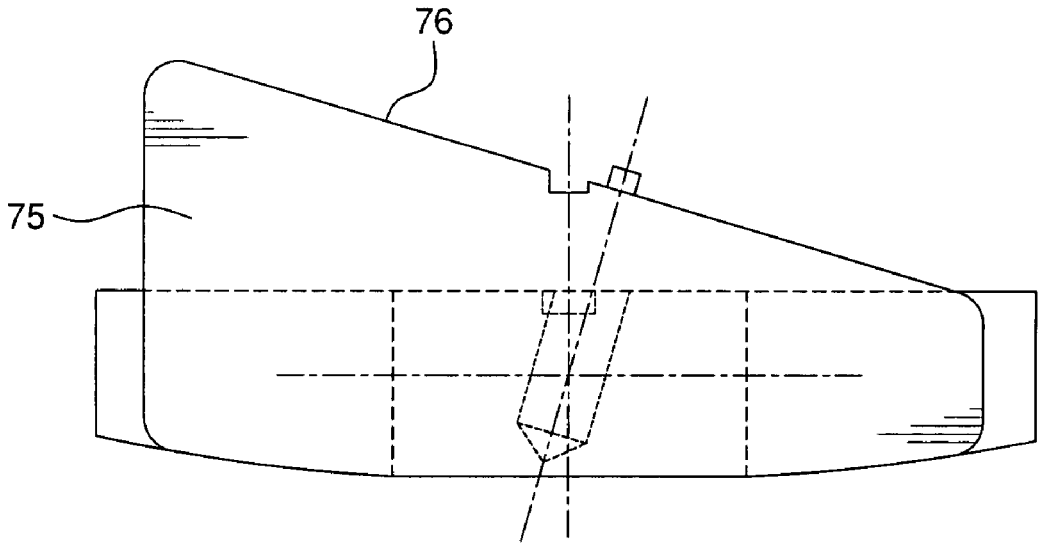
FIGS. 9*a*-9*b* are front views of other design embodiments of putter heads employing the present invention.
Figure 9B:
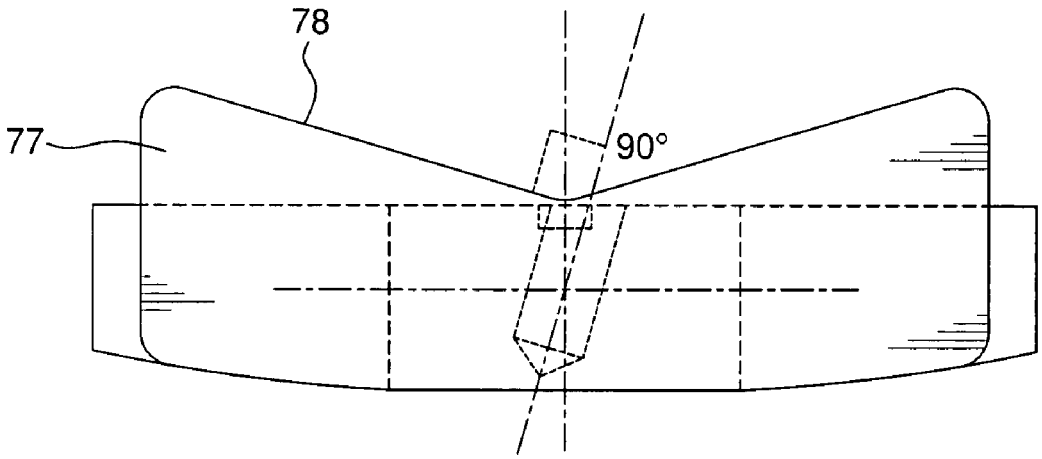

As with putter head shapes, various putter face configurations can be utilized with beam putters of the present invention. For purposes of example only, three such faces are shown in FIGS. 3, 9*a* and 9*b*. FIG. 3 is a normal face 10 wherein the height of the face is consistent with the height of the putter body, as described previously.

FIG. 9*a* depicts putter face 75 that is useful for plumb bobbing in accordance with U.S. Pat. No. 6,358,162. When the putter is suspended by the shaft, top surface 76 of putter face 75 is truly horizontal and provides a ready reference to estimate slopes around the hole and elsewhere on the green. In this design, weights are strategically distributed (or eliminated) around the head to provide toe to heel and face to back balance in order for the putter shaft to hang in a truly vertical alignment.

FIG. 9*b* depicts putter face 77 a variation of FIG. 9*a* wherein the shaft will hang in a truly vertical alignment as a result of the symmetrical weight distribution from toe to heel around each side of the vertical axis of the center of mass. Depending on whether the putter is designed for righthanded or lefthanded golfers, the top surfaces of the portion of the face towards toe 78 (left portion for righthanded golfers or the right portion for lefthanded golfers in the drawing shown) will be aligned as a truly horizontal reference as viewed in FIG. 9*a*. Depending on the head design, weight may be required in the side opposite the face to provide face to back balance.

As previously described, many beam materials, shapes and designs may be used to obtain the characteristic time desired. As a result, the ability to easily substitute different beam members is important. While many design concepts are available, FIGS. 10 and 11*a*-*c* show a simple version of such a design connection between a beam member and perimeter wall member of the putter head. Removal and reconnection of beam members must always conform with USGA requirements.

Figure 10:
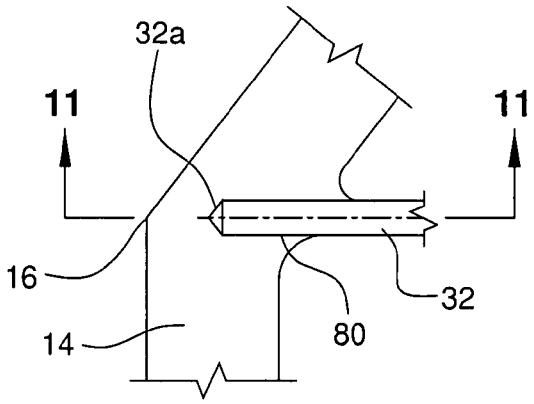
FIG. 10 shows a connection between a beam section of the present invention and a perimeter wall member of the putter head.
Figure 11A:
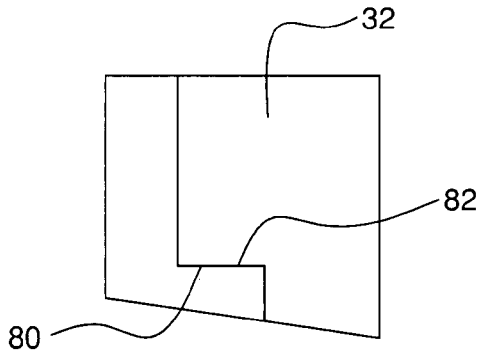
FIGS. 11*a*-11*c* are cross-sectional views showing various stages of the connection process.
Figure 11B:
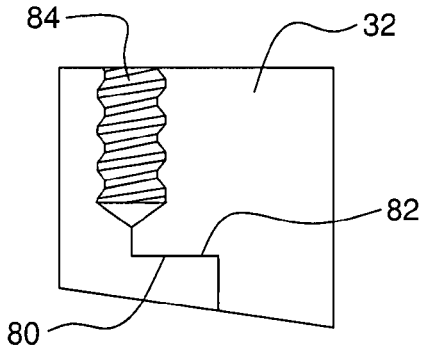
Figure 11C:
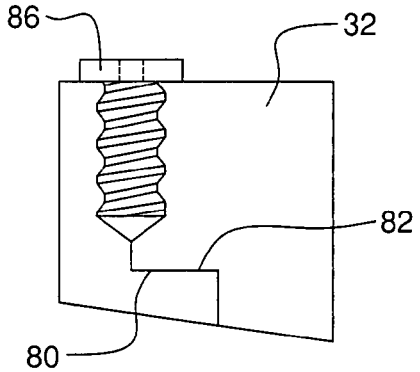
Figure 12:
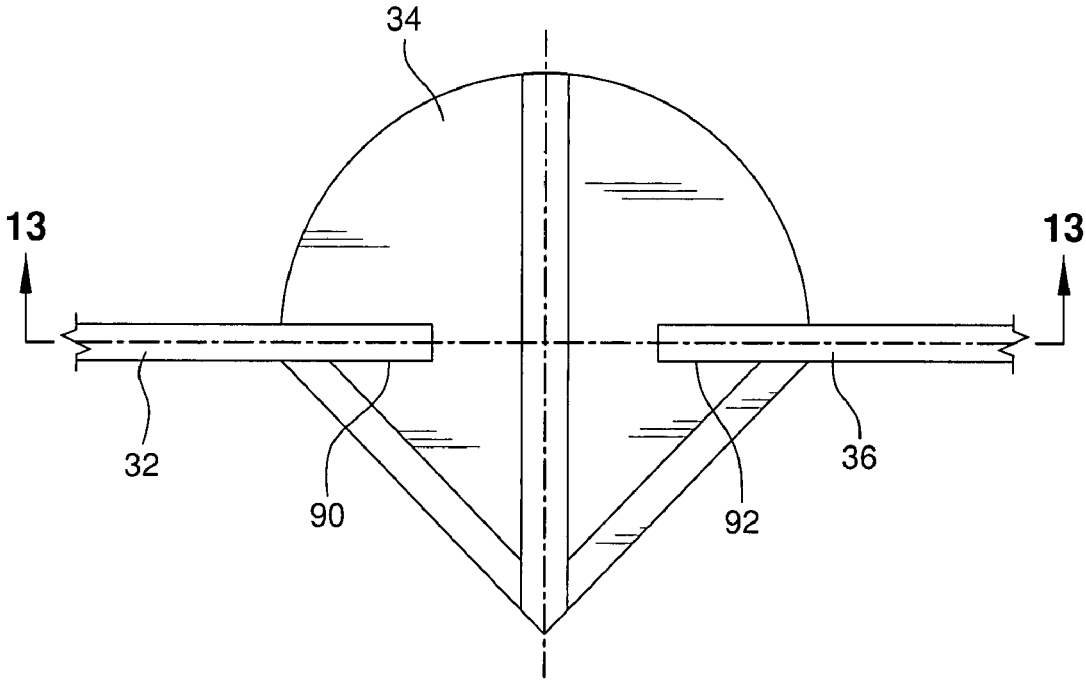
FIG. 12 shows a connection between the beam sections and central beam section of the present invention.

FIG. 10 is a close-up view of the beam to perimeter wall member connection. During manufacture, slots 80 are machined into perimeter wall member 16 where the ends of beam section 32 would normally be located. Slots 80 are shaped to suit beam ends 32*a* and extend about halfway into perimeter wall member 14, as shown in FIGS. 11*a*-11*c*, stopping short of the putter sole. Beam section 32 is stepped at 82, the bottom of its ends, so that when inserted into slots 80, the beam comes to a positive stop. Hole 84 is drilled to accommodate a properly sized bolt, stopping just short of the depth of slot 80, whose diameter is such that a small amount of material is also removed from ends 32*a* of beam section 32. Hole 84 is then tapped to provide clamping of beam section 32 to perimeter wall member 14 with bolt or screw 86. Alternately, the portion of the beam which is inserted into the body may be of a different shape than the beam, such as a larger shape with tapered sides matching slots in the body, which would provide more secure clamping capabilities.

Figure 13A:
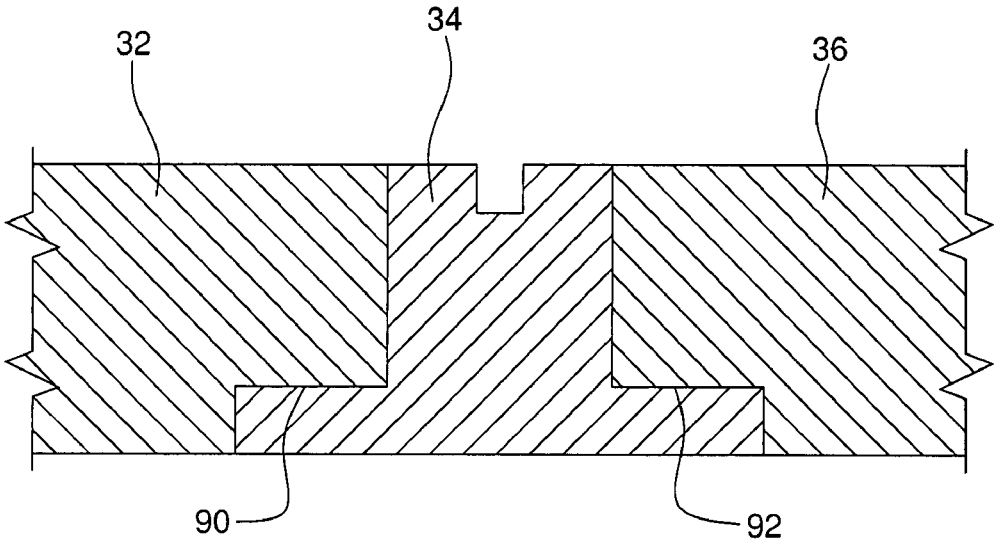
FIGS. 13*a*-13*c* are cross-sectional views showing various stages of the connection process.
Figure 13B:
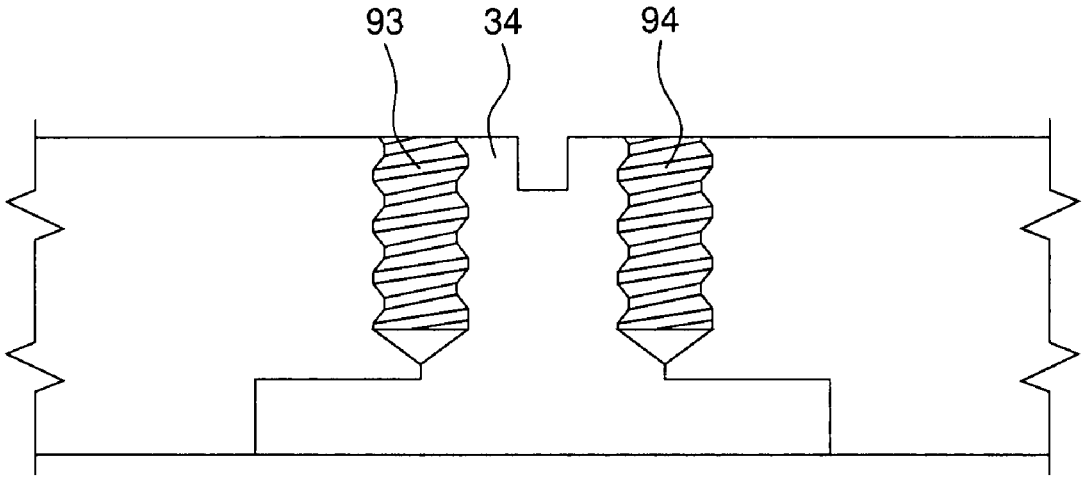
Figure 13C:
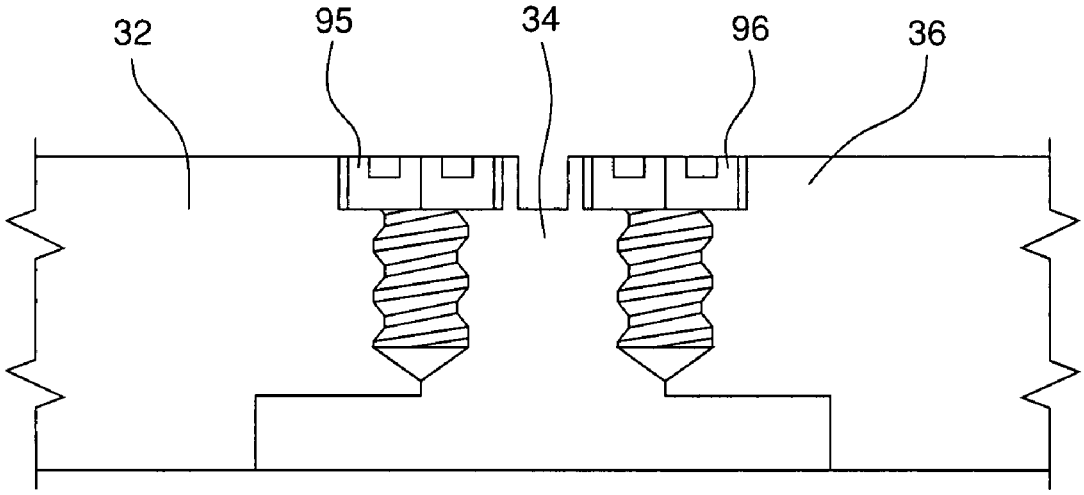

This design concept can also be utilized by providing a replaceable shaft connector for beam sections 32 and 36 in central beam member 34. Beam sections 32 and 36 are attached to beam member 34, by providing slots 90 and 92 in the central beam member 34 into which the beam sections are inserted. FIGS. 13*a*-13c show this connection, with holes 93 and 94 tapped between beam sections 32 and 36 and central beam member 34. Again bolts or screws 95 and 96 are inserted in holes 93 and 94 to secure the connection.

The connection designs shown in FIGS. 10, 11*a*-11*c*, 12 and 13*a*-13*c* make it possible to utilize beams and shaft connectors of many different materials and designs, demonstrating that different connection configurations may be employed which incorporate the beam concept.

Sighting Alignment

Failure to follow the intended putting line during the putting stroke may result in a mishit, since a visual signal to the brain that the putter is off line can initiate a cognitive signal to correct the problem. There are two principle causes of off line swings:

1. Misalignment of the club with the intended putting line during setup.

2. Deviation of the club from the intended putting line during the swing.

It is generally recommended that when lining up a ball to be putted, the golfer should position the ball close to his front foot with his/her left eye (for a righthanded golfer) directly over the ball or slightly closer to his/her foot than the ball. Most putters have an alignment mark on the top surface of the putter directly above the sweet spot on the face of the putter when the putter is properly soled. When the intended putting line is determined, the putter face should be lined up perpendicular to the intended putting line with the alignment mark directly in back of the ball and also on the intended putting line. For a righthanded golfer whose dominant eye is also the right eye, this places the sighting eye, the alignment mark, and the ball in a straight line for viewing the ball path on the intended putting line. The fundamental problem occurs in the difficulty in placing the dominant eye properly and there are many putters which use arrows, balls or other means of positioning the eye properly. Although the direction and path a ball will take is primarily a function of the swing path (outside in, on line, inside out, or parallel to but off the putting line), it is the aiming of the putter face square to the intended putting line when the putter impacts the ball which can introduce or exacerbate an error in each of the swing paths described. One thing is clear. Unless the putter face is square to and the sweet spot is on the intended putting line, starting with a built in error only complicates the putting swing.

While many teachers understand the importance of the dominant eye being properly in line with the putting line, it is curious to note that some teachers ascribe a ball path when struck inside the intended putting line being at least partially due to the dominant eye being inside the intended putting line at setup. Others cite the reverse, saying a pulled putt is due to an outside in swing, ignoring the issue which is properly aiming the putter face to be square to the putting line at both set up and at impact. While all acknowledge the importance of proper alignment at set up and at impact, it is clear that a proper understanding is required of how significant the location of the dominant eye is in relation to the intended putting line.

Figure 15A:
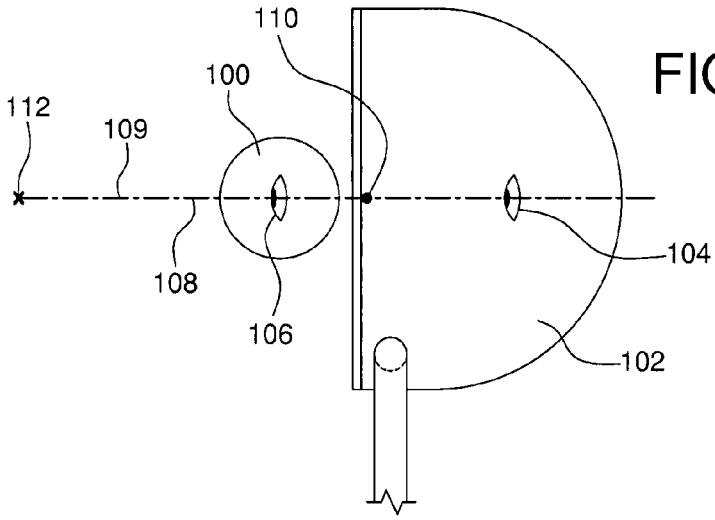
FIG. 15*a* is a plan view of a putter illustrating a correct putter hit.
Figure 15B:
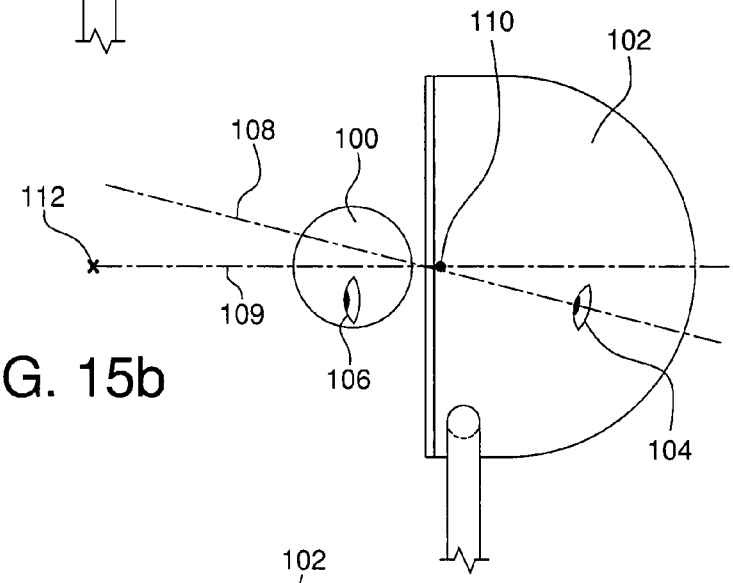
FIGS. 15*b* and 15*c* are plan views of putters illustrating putter mishits due to improper dominant eye location.
Figure 15C:
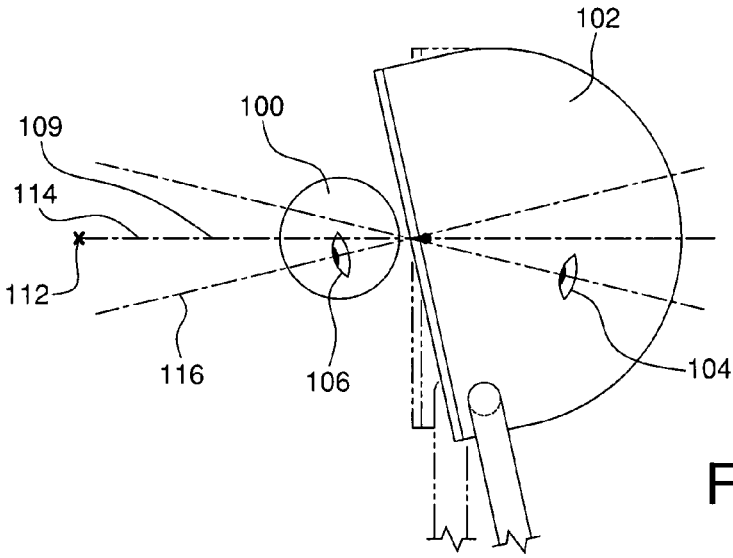

Assuming that the path of the putter is on the intended putting line during take away and the impact portion of the stroke, (i.e. there is no rotation of the wrists either opening or hooding the club face), balls which are pulled or pushed as a result of what may be considered a perfect swing can only be due to the face of the putter being improperly aligned during set up. Keep in mind that a face which is out of square to the intended putting line by only 1 degree will result in being over 3 inches offline (enough to miss the edge of a hole) only 15 feet away. Yet most golfers find it difficult to discriminate an angle within 2 or 3 degrees of being square to the putting line, which in the absence of a guide, is a mental image. For this reason, many golfers try to select a spot 5-15 inches ahead of the ball and aim the alignment mark at that spot during set up. FIGS. 15*a*-15*c* illustrate how improper location of the dominant eye can easily introduce an error of 3 degrees or more of the putter face being out of square with the intended putting line at set up.

FIG. 15*a* illustrates putter 102 lining up ball 100 for a putt aligned with dominant eye 104 and left eye 106 as is generally recommended. Note that visual sight line 108, intended putting line 109, dominant eye 104, left eye 106, alignment mark 110, and putting line target 112 are all on a straight line.

FIG. 15*b* illustrates the same conditions as FIG. 15*a*, except that both dominant eye 104 and left eye 106 are positioned approximately ½ inch inside intended putting line 109 (closer to the golfer's feet). Note that when dominant eye line of sight 108 passes through alignment mark 110, the visual sight line passes well above (outside) of putting line target 112.

FIG. 15*c* illustrates the golfer's actions to correct this. To accomplish this, the golfer intuitively rotates putter head 102, while trying to keep dominant eye 104 in the same relative position. This may be accomplished by rotating the shaft, changing the grip position, or by repositioning the feet or body which would move the grip location, shaft and/or dominant eye location. New visual sight line 114 and intended putting line 109 will, in the golfer's mind, now line up properly with each other, however the face of putter 102 is now closed to the intended putting line. Depending on whether putter head 102 stays on intended putting line 109 or is struck on an outside path, ball 100 in both cases will result in travel path 116 to the left of target 112.

Note also that in order to minimize this problem, many golfers position their left eye and dominant eye further back than is generally recommended, increasing the distance from their dominant eye to the alignment arrow. This decreases the error angle and once the putting line is established, the golfer repositions his feet to whatever is normal for him.

In order to more accurately position the dominant eye directly over the intended putting line, the present invention provides a sighting alignment groove or slot in the top surface of the putter head. By providing one or more strips of a contrasting color on the base of the slot, one can determine whether one's dominant eye is properly centered over the intended putting line. Either a part of or all of a slot will be obscured if the dominant eye is not properly positioned. Additionally, if the dominant eye is positioned back of the putter head, any rotation of the putter head off line will similarly obscure a part of one or more of the contrasting sight lines.

Figure 16:
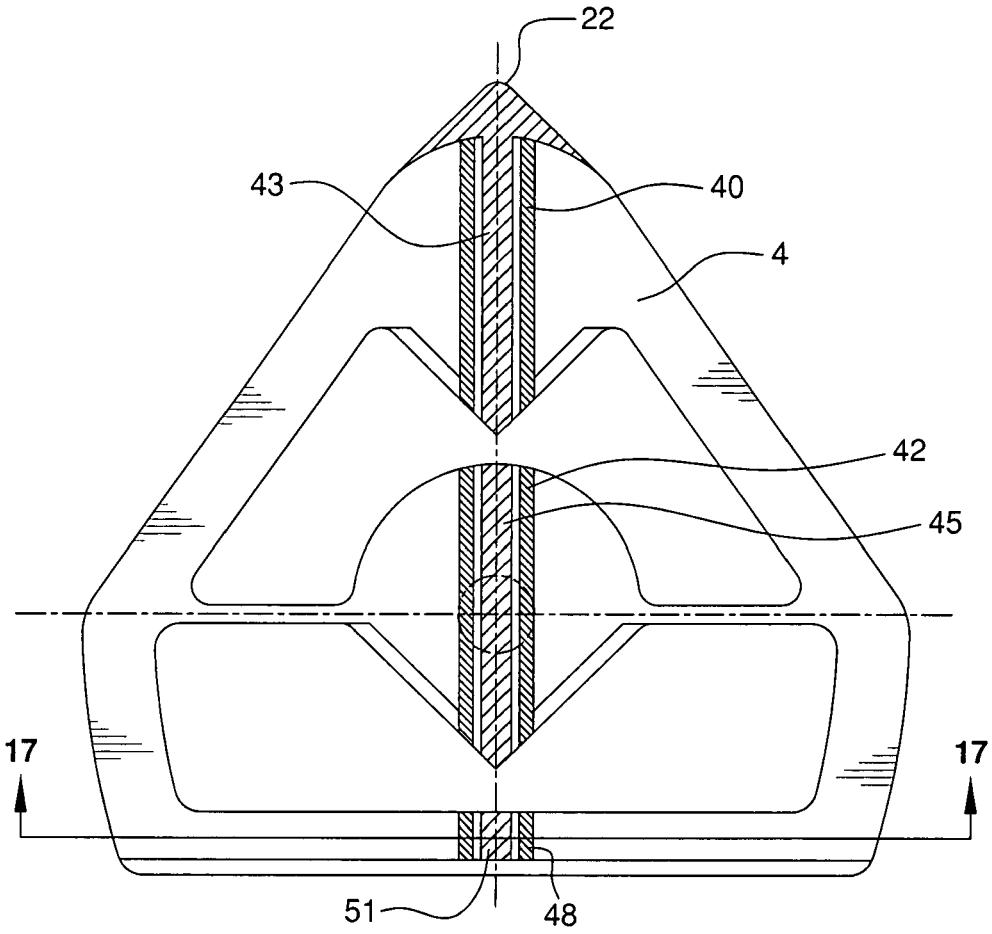
FIG. 16 is a plan view of the putter of the present invention employing the sight alignment configuration of the present invention.
Figure 17:
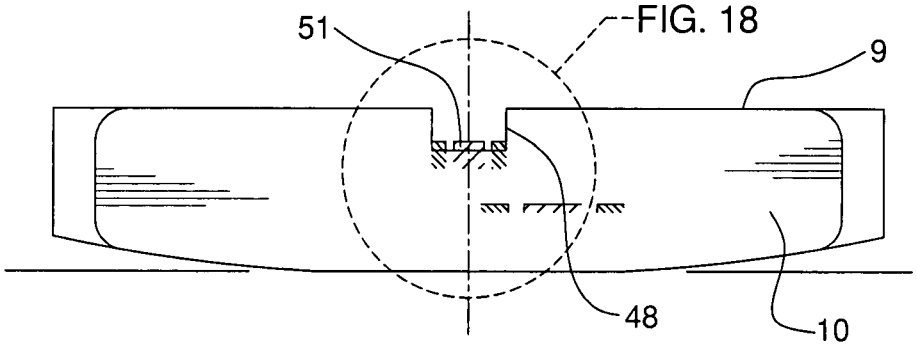
FIG. 17 is a section view taken from FIG. 16.
Figure 18:
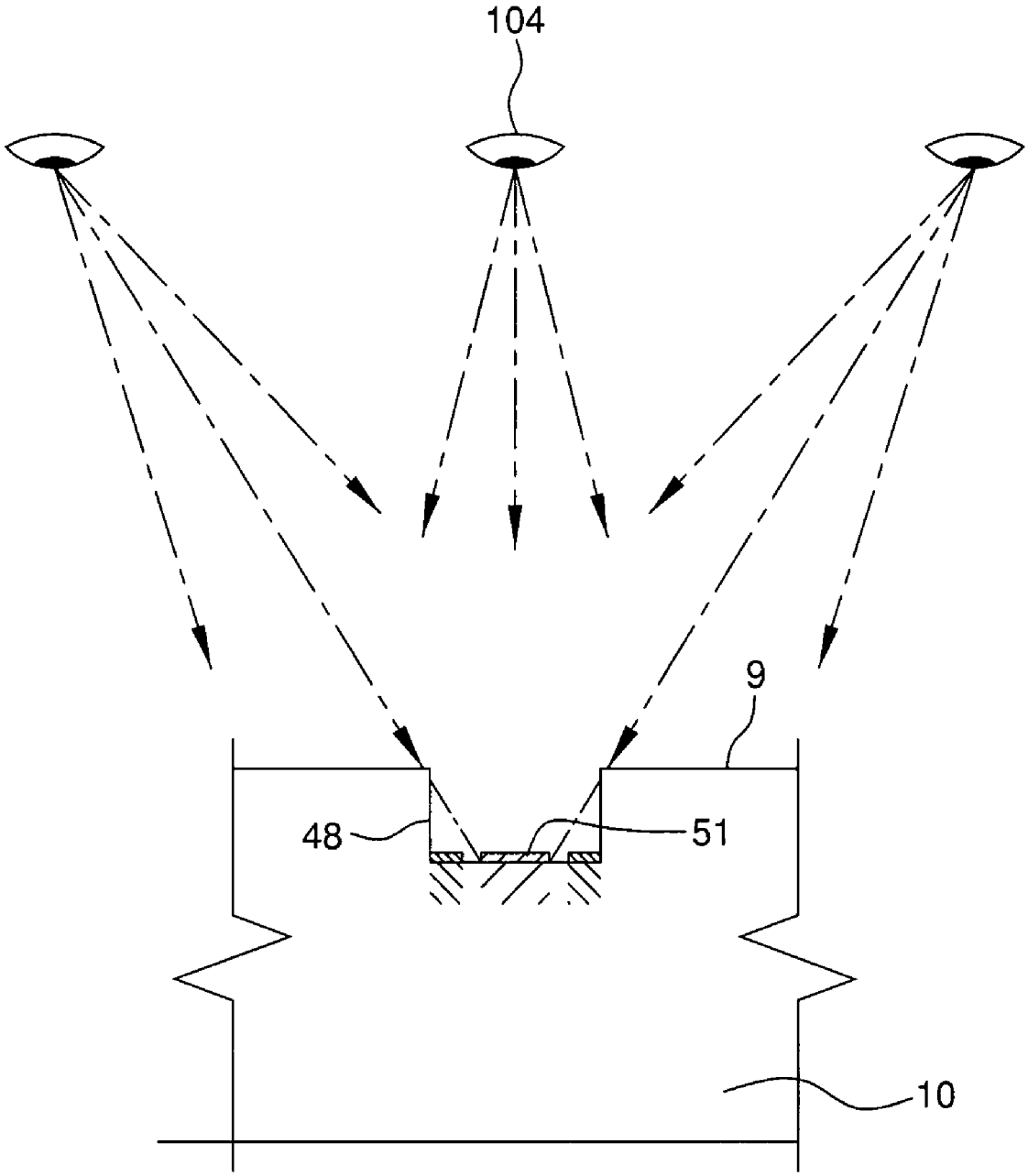
FIG. 18 is a front view, similar to FIG. 17 but in a larger scale, showing sight alignment technique.

For example, sighting alignment slots or grooves 40, 42 and 48 have an exemplar width and depth of approximately ¼", formed within crown surface 9 of putter head 4. See FIGS. 16-18. Grooves 40, 42 and 48 extend from face 10 to back end 22, each groove having substantially vertical (as shown in the figures) or tapered sides of approximately between 0-10 degrees. The grooves are perpendicular to the face of the putter and are positioned directly above and parallel to the center of mass and the sweet spot so that they can be positioned directly over the intended putting line when the putter is properly soled on the putting surface. Base surfaces 43, 45 and 51 of grooves 40, 42 and 48 are provided with one or more stripes of contrasting colors, so the golfer can determine whether his or her dominant eye 104 is properly located directly over the grooves and centered over intended putting line. When properly centered all stripped, colored areas of the bases are visible to the golfer. If the dominant eye is not properly positioned, all stripes cannot be seen. See FIG. 18.

Figure 19A:
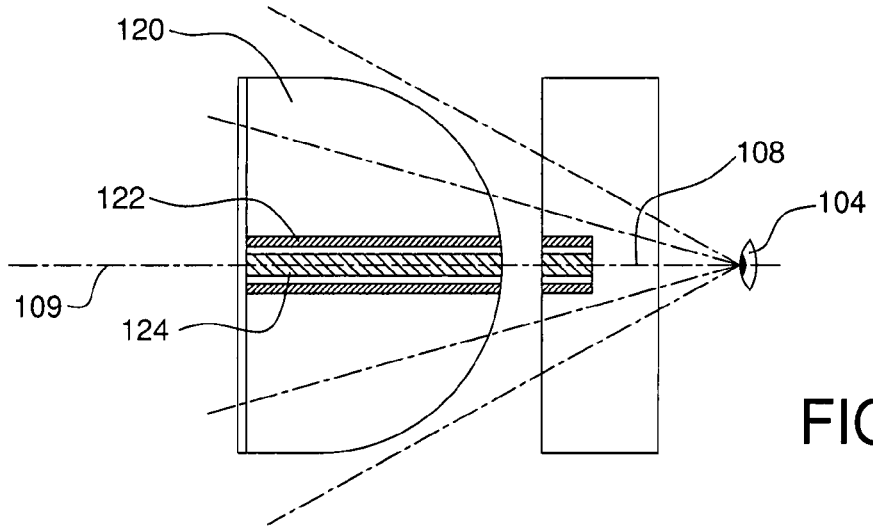
FIG. 19*a* is a plan view of a conventional putter employing the sight alignment configuration of the present invention.

FIG. 19*a* shows the sighting alignment grooves of the present invention in use with a standard mallet putter. Putter head 120 comprises groove 122 with base 124 having one or more stripes of contrasting colors. Dominant eye 104 and putter head 120 are aligned on intended putting line 109 and line of sight 108. All stripped colored areas in groove 122 are visible and putter is properly aligned.

Figure 19B:
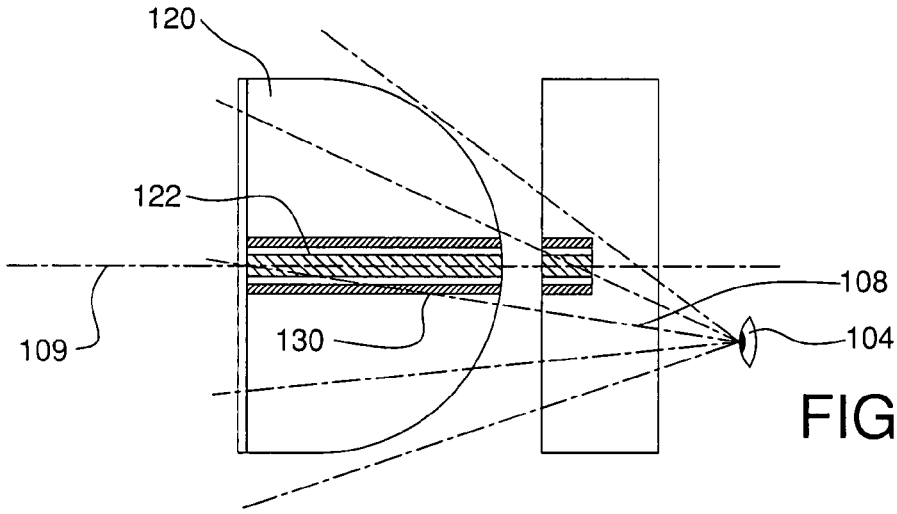
FIGS. 19*b* and 19*c* are plan views of putters illustrating additional putter mishits due to improper dominant eye location.

FIG. 19*b* shows putter head 120 aligned on intending putting line 109, but dominant eye 104 is below the line, closer to the golfer's feet. In this case, line of sight 108 intersects with the top of groove 122 at point 130. Every part of groove 122 above line of sight 108 is clearly visible, since groove walls are not obscured. At point 130, everything below line of sight 108 to the left of point 130, cannot be seen if within groove 122.

Figure 19C:
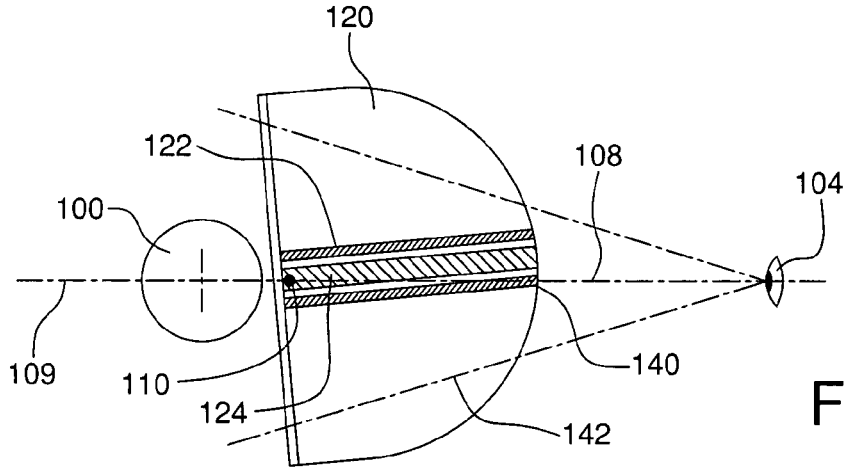

FIG. 19*c* presents the situation in which dominant eye 104 is close to the ground. Everything below line of sight 108 to the left of point 140 cannot be seen if within groove 122 and between the line of sight and lower image line of sight 142. Dominant eye 104, intended putting line 109, line of sight 108, alignment mark 110 and center of ball 100 all coincide, but the axis of the head is askew. However, since the golfer's eye is well above putter head 120, it is difficult to determine when this situation exists. Although uncommon, this occurs when the golfer lowers his head and dominant eye until it is very close to the ground. Alternatively, standing back of the ball and holding the putter head at eye level and parallel to the putting surface, the golfer can align the intended putter line, the ball, and the line of sight. This automatically squares the putter face to the intended putter line. By selecting a point in front and back of the ball, the golfer can position the putter properly. In addition, a mental image of the putter face toe and heel can act as a t-square to aid in positioning the putter.

Certain novel features and components of this invention are disclosed in detail in order to make the invention clear in at least one form thereof. However, it is clearly to be understood that the invention as disclosed is not necessarily limited to the exact form and details as disclosed, since it is apparent that various modifications and changes may be made without departing from the spirit of the invention.

The invention claimed is:

1. A golf putter having a shaft and a putter head, said putter head comprising:

a body having a front member with a putter face having a sweet spot to be aligned with a desired putting line and a rear section, perimeter wall members connected to and extending from the putter face to the rear section of the body, an opening within and extending through the body, said opening being bordered by and enclosed within the front member, the perimeter wall members and the rear section, and an actively compliant beam member extending parallel to the putter face of the front member and being particularly configured to deflect upon putter face impact with a golf ball, the deflection of the beam member being greater than the golf ball impact deflection of the putter face, said beam member being located within and extending uninterrupted completely across the entire length of the opening, the beam member being secured to the putter head solely by connection directly to the perimeter wall members and means for attaching the shaft directly to the beam member at a location between the perimeter wall members, whereby golf ball impact upon the putter face causes deflection of the beam member resulting in maintenance of the orientation of the putter face with respect to the putting line.

2. The golf putter as in claim 1 wherein the beam member comprises a central member interconnected between two lateral beam members.

3. The golf putter as in claim 1 wherein the beam member comprises a single beam extending between the wall members.

4. The golf putter as in claim 1 whereby the shaft is attached at an angle greater than 10 degrees from a vertical plane.

5. The golf putter as in claim 1 wherein the body includes two perimeter wall members.

6. The golf putter as in claim 1 wherein the perimeter walls comprise a rearward section and a forward section and the beam member extends between these sections.

7. The golf putter as in claim 1 wherein the putter has a center of mass and the putter face has a sweet spot, whereby upon application of a momentary impact force offset from the sweet spot, a torque is produced about a fixed axis through the center of mass of the putter, the beam member producing a counter-torque when the impact force begins to decrease.

8. The golf putter as in claim 1 wherein the putter face has a sweet spot to be aligned with a desired putting line, whereby the impact between a golf ball and the putter face at a location offset from the sweet spot results in deflection of the beam member followed by substantially simultaneous recovery of the beam member, causing the putter face to return perpendicular to the desired putting line at almost the same instant the golf ball leaves the putter face.

9. The golf putter as in claim 8 wherein the deflection and recovery of the beam member to cause the putter face to return to the desired putting line is the characteristic time of the beam member.

10. The golf putter as in claim 1 further comprising means to connect the beam member to the wall members to allow removal and reconnection of the beam member or alternate beam members to the wall members.

11. A golf putter having a shaft and a putter head, said putter head comprising:

a body having a front member with a putter face having a sweet spot to be aligned with a desired putting line, a rear section, perimeter wall members extending from the putter face to the rear section of the body, and actively compliant beam means for correcting golf ball mishits upon golf ball impact with the putter face, the beam means being particularly configured to deflect upon putter face impact with a golf ball, the deflection of the beam means being greater than the golf ball impact deflection of the putter face, whereby the impact between the golf ball and the putter face on the sweet spot results in deflection of the beam means in proportion to the force of the impact while maintaining the putter face orientation with respect to the putting line at almost the same instant the ball leaves the putter face, and is followed by beam means recovery from the deflection, said beam means recovery directly affecting the angular orientation of the putter face in order to correct golf ball mish its by causing the putter face to return perpendicular to the desired putting line at almost the same instant the golf ball leaves the putter face, said beam means being positioned parallel to the putter face and being located rearward of the front member and extending uninterrupted between and connected directly to the perimeter wall members, and means for attaching the shaft directly to the beam member at a location between the perimeter wall members.

12. The golf putter as in claim 11 wherein the beam means comprises a central member interconnected between two lateral beam members.

13. The golf putter as in claim 11 wherein the beam means comprises a single beam extending between the wall members.

14. The golf putter as in claim 11 whereby the shaft is attached at an angle greater than 10 degrees from a vertical plane.

15. The golf putter as in claim 11 wherein the body includes two perimeter wall members.

16. The golf putter as in claim 11 wherein the perimeter walls comprise a rearward section and a forward section and the beam means extends from these two sections.

17. The golf putter as in claim 11 wherein the putter has a center of mass, whereby upon application of a momentary impact force offset from the sweet spot, a torque is produced about a fixed axis through the center of mass of the putter, the beam means producing a counter-torque when the impact force begins to decrease.

18. The golf putter as in claim 11 wherein the deflection and recovery of the beam means to cause the putter face to return to its original putting line is the characteristic time of the beam means.

19. The golf putter as in claim 11 further comprising means to connect the beam means to the wall members to allow removal and reconnection of the beam means or alternate beam means to the wall members.

20. A golf putter having a shaft and a putter head, said putter having a given center of mass and further comprising:

a body having a front member with a putter face having a sweet spot, a rear section, perimeter wall members, and actively compliant beam means being positioned nearer the putter face than the rear section, the beam means for storing energy produced by the force of putter face impact with a golf ball, the beam means being particularly configured to deflect upon putter face impact with a golf ball, the deflection of the beam means being greater than the golf ball impact deflection of the putter face, whereby when the putter face impact with the golf ball is offset from the sweet spot of the putter face, a torque is produced about a fixed vertical axis through the center of mass of the putter, the beam means producing a counter- torque when the force produced by the impact begins to decrease, said beam means being located rearward of the front member, positioned parallel to the putter face and extending uninterrupted between and connected directly to the perimeter wall members, and means for attaching the shaft directly to the beam means at a location between the perimeter wall members.

21. The golf putter as in claim 20 wherein the beam means comprises a central member interconnected between two lateral beam members.

22. The golf putter as in claim 20 wherein the beam means comprises a single beam extending between perimeter wall members.

23. The golf putter as in claim 20 whereby the shaft is attached at an angle greater than 10 degrees from a vertical plane.

24. The golf putter as in claim 20 wherein the body includes two perimeter wall members.

25. The golf putter as in claim 24 wherein the perimeter walls comprise a rearward section and a forward section and the beam means extends from these two sections.

26. The golf putter as in claim 20 wherein the sweet spot of putter face is to be aligned with a desired putting line whereby the deflection of the beam means and simultaneous recovery of the beam means, causing the putter face to return to the desired putting line at almost the same instant the ball leaves the putter face.

27. The golf putter as in claim 26 wherein the deflection and recovery of the beam means to cause the putter face to return to the desired putting line is the characteristic time of the beam means.

28. The golf putter as in claim 20 further comprising means to connect the beam means within the body to allow removal and reconnection of the beam means or alternate beam means within the body.

29. A golf putter having a shaft and a putter head with a putter face having a sweet spot, said putter having a given moment of inertia which produces forces perpendicular to the center of mass of the putter when there is putter head impact with a golf ball offset from the sweet spot, said putter head comprising: a body having a front member with said putter face, a rear section, perimeter wall members, and deflection means for storing energy produced upon putter face impact with a golf ball, the deflection means being particularly configured to flex upon putter face impact with a golf ball, the flexure of the deflection means being greater than the golf ball impact flexure of the putter face, whereby the energy stored within the deflection means causes a decrease in the dynamic moment of inertia of the putter, resulting in an overall increase in the feel of the putter, said deflection means being positioned parallel to the putter face and nearer the putter face than the rear section, and means for attaching the shaft directly to the deflection means at a location between the perimeter wall members.

30. The putter as in claim 29 wherein an increase in overall feel of the putter is caused by an increase in magnitude of sense of touch of the putter.

31. The putter as in claim 30 wherein the increase in the feel of the putter is a tactile feel.

32. The putter as in claim 30 wherein the increase in the feel of the putter is a kinesthetic feel.

33. The putter as in claim 30 wherein the increase in the feel of the putter is a visual feel.

34. The putter as in claim 30 wherein the increase in the feel of the putter is an intuitive feel.

35. The putter as in claim 30 wherein the increase in the feel of the putter is a sound feel.

36. The putter as in claim 35 wherein a range of sound feel frequencies of the putter is between 1000 to 4000 hz.

37. The putter as in claim 36 wherein the moment of inertia of the putter is in a range of 2000 to 8000 grams*$cm^2$.

* * * * *